United States Patent [19]

Stapp et al.

[11] 3,978,785

[45] Sept. 7, 1976

[54] STACKING AND BUNDLING MACHINE

[75] Inventors: Willis J. Stapp; Norman P. Crowe; Edwin A. Molitor, all of Clermont City, Ohio

[73] Assignee: Multifold-International, Inc., Milford, Ohio

[22] Filed: June 23, 1975

[21] Appl. No.: 589,545

Related U.S. Application Data

[62] Division of Ser. No. 476,578, June 5, 1974, Pat. No. 3,907,129.

[52] U.S. Cl. ..... 100/215; 100/218; 214/6 D

[51] Int. Cl.[2] ..... B30B 15/30

[58] Field of Search ..... 214/6 C, 6 D; 100/215, 100/218; 93/93 R

[56] References Cited

UNITED STATES PATENTS

| | | | |
|---|---|---|---|
| 2,985,323 | 5/1961 | Wilson et al. | 214/6 C |
| 3,107,793 | 10/1963 | Frank | 100/215 X |
| 3,115,090 | 12/1963 | Elander | 100/215 |
| 3,567,046 | 3/1971 | Reist | 100/215 X |
| 3,832,938 | 9/1974 | Stapp et al. | 214/6 C |
| 3,908,539 | 9/1975 | O'Brien | 100/215 X |

*Primary Examiner*—Billy J. Wilhite

*Attorney, Agent, or Firm*—James W. Pearce; Roy F. Schaeperklaus

[57] ABSTRACT

A machine for stacking and bundling flat articles. The articles are collected in a stack on an elevator arm. The stack is compressed and advanced into a generally U-shaped basket having parallel spaced sides. The basket can swing about an upright axis and about a horizontal axis. The basket swings about the horizontal axis to a lay-over position in which the sides of the basket are upright. The stack is pushed from the basket when in lay-over position. A tray portion of the basket can be adjusted crosswise of the basket to accommodate stacks of articles of various sizes. The horizontal axis can be advanced along a 45° angle to the horizontal so that the tray position at the lay-over basket position can be at the same height for various positions of the tray member in the basket.

7 Claims, 29 Drawing Figures

FIG. 7
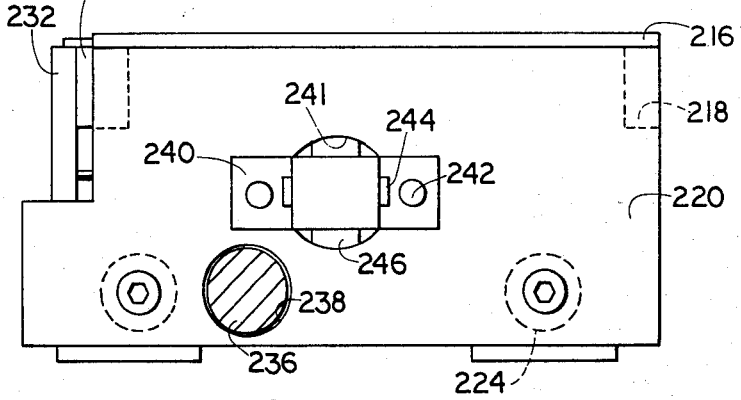
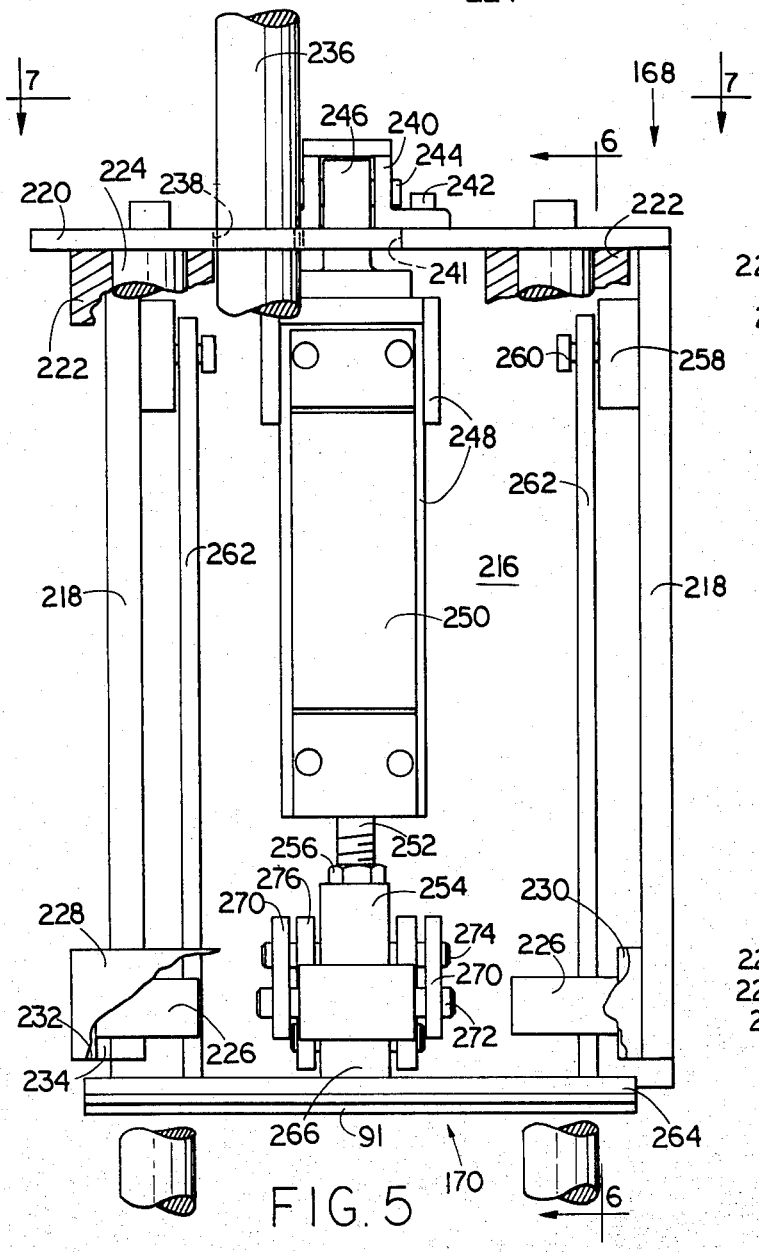
FIG. 5
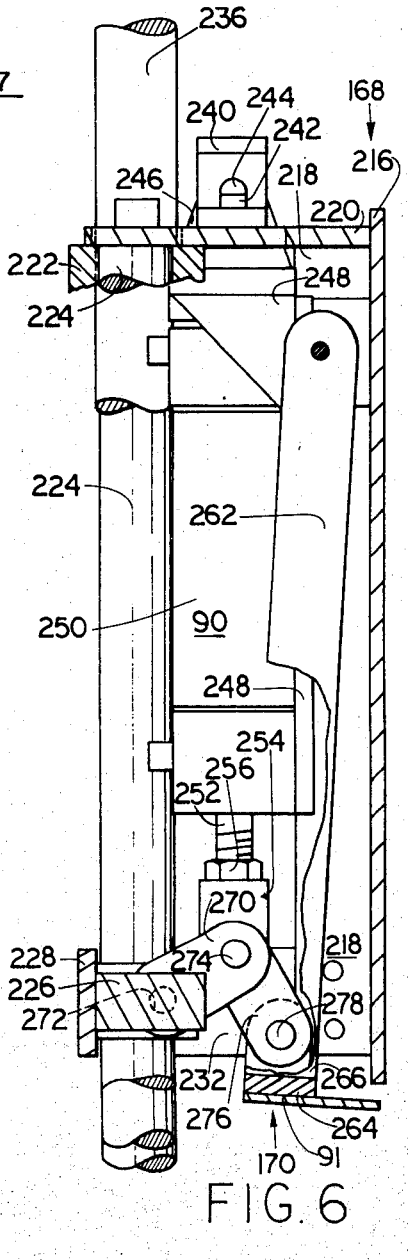
FIG. 6

224
352
96
236
440
442
362
364
374
396
394
388
392
390
384
386
382
360
358
381
356
372
380
370
366
368
378
376
98
350
282
280
391
8
9
10

STACKING AND BUNDLING MACHINE

This is a division of our copending application Ser. No. 476,578, filed June 5, 1974 now Pat. No. 3,907,129.

This invention relates to a machine for handling cartons and the like. More particularly, this invention relates to a machine for assembling cartons in bundles.

An object of this invention is to provide a machine of this type in which flat articles such as flat cartons or the like are assembled in a stack and in which the stack is compressed into a bundle which is transferred from the assembly portion of the machine into a basket in which the compressed stack is held until discharged from the machine.

A further object of this invention is to provide such a machine in which the flat cartons are assembled in a vertical stack that is advanced into the basket while the stack remains vertical, and in which the basket is turned 90° about an upright axis and also 90° about a horizontal axis with the stack inside the basket before the stack is discharged with the stack extending horizontally.

A further object of this invention is to provide such a machine in which there is means for advancing the vertical stack into the basket which advances to a predetermined station to deliver the stack into the basket with a trailing face of the vertical stack at a predetermined position, there is a tray member in the basket which is upright when the basket is in stack receiving position which is arranged to support a face of the stack, and the tray member can be advanced crosswise of the basket to accommodate stacks of varying width between opposed faces.

A further object of this invention is to provide such a machine in which the vertical stack rests on a side of the basket when the basket is in stack receiving position. the tray member intersecting said side, and means is provided for moving the horizontal axis with respect to the basket as the position of the tray member in the basket is changed so that, when the basket is swung 90° about the horizontal axis, the intersection between said side of the basket and the tray member is swung to a common position for varying positions of the tray member in the basket.

A further object of this invention is to provide such a machine in which the horizontal axis is supported in a turn box which can turn 90° about the vertical axis to swing the basket about the vertical axis and the horizontal axis is advanceable in the turn box to adjust the position of the horizontal axis with relation to the basket.

A further object of this invention is to provide stack compressing mechanism for such a machine which grips the tip of the vertical stack at edges of the upper face thereof and compresses the stack on an elevator.

A further object of this invention is to provide such a machine which can be adjusted to accept flat cartons of various sizes.

Briefly, this invention provides a carton assembling and bundling machine in which flat cartons are delivered to a first elevator in which a first portion of a stack is accumulated by machinery of the type shown and claimed in U.S. Pat. No. 3,832,938 issued Sept. 3, 1974. When the first portion of the stack has been accumulated, the stack is transferred to a second elevator on which the remainder of the stack is accumulated.

The first elevator is provided with readily releasable flange members which support the first portion of the stack as it is being accumulated and which can be swung quickly out of position to release the first portion of the stack onto the second elevator when the elevators are aligned. When a full stack has been accumulated, a stack compressing device compresses the stack on the second elevator. The stack compressing device has flange members which are parallel to arms of the second elevator. The compressed stack is discharged lengthwise of the elevator arms and the presser feet into a basket which holds the compressed stack while the basket is first turned 90° about a vertical axis and is then laid over to align the axis of the stack to a horizontal position at which the stack is discharged.

The basket is pivotally supported for swinging about a horizontal axis. The horizontal axis is mounted in a turn box which can swing about a vertical axis to swing the basket 90° about the vertical axis. When the stack is in an upright position, the stack rests on a side of the basket. A tray member is mounted in the basket and can be adjusted crosswise of the basket to accommodate stacks of varying thickness. The horizontal axis is movable along the turn box along a plane on an angle of 90° to the vertical to permit adjustment of the basket so that the intersection of the tray member and said side of the basket is brought to the same position when the basket has been turned 90° about the horizontal axis for various positions of the tray member in the basket and said side of the basket is at a predetermined height when the basket is in stack receiving position for all positions of the tray member.

The stack is discharged from the basket by a basket clearing pusher assembly which advances the stack transversely of the direction the stack is advanced into the basket. The machine can be arranged to place a flat pad at each end of the stack.

The above and other objects and features of the invention will be apparent to those skilled in the art to which this invention pertains from the following detailed description and the drawings in which:

FIG. 5 is an enlarged fragmentary view in side elevation of a portion of the auxiliary elevator assembly, parts being broken away for clarity;

FIG. 6 is a view in section taken on the line 6—6 in FIG. 5;

FIG. 7 is a view in section taken on the line 7—7 in FIG. 5;

In the following detailed description and the drawings, like reference characters indicate like parts.

GENERAL DESCRIPTION

Figure 1:
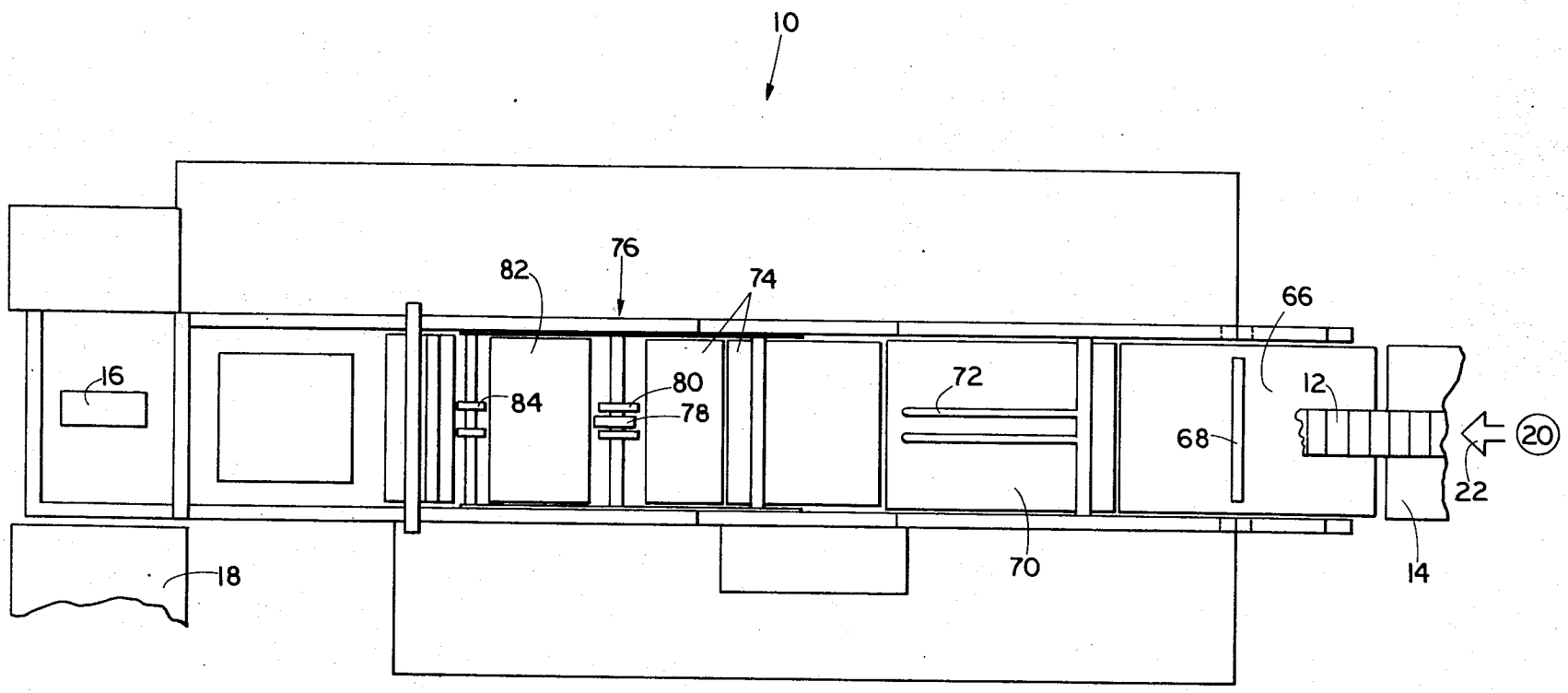
FIG. 1 is a schematic plan view of a bundle accumulator machine constructed in accordance with an embodiment of this invention.

FIG. 1 shows a bundle accumulator machine 10 which is constructed in accordance with an embodiment of this invention. The bundle accumulator machine 10 accepts a procession of flattened cartons 12, overlapped in a shingled fashion, from an apron conveyor 14 located to the right of the bundle accumulator machine 10. This is hereinafter termed the "feed end" of the bundle accumulator machine 10. The apron conveyor 14 is the terminus of a sealer/glue machine (not shown) which provides the shingled procession of cartons 12 for packaging. The bundle accumulator machine 10 delivers at timed intervals, and in proper orientation, a stack of cartons 16 to a cassette receiver 18 of a bundle overwrap machine (not shown in detail) that is generally located to the left of the bundle accumulator machine 10. This is hereinafter termed the "output end" of the bundle accumulator machine 10.

Orientation terms to be used hereafter are now defined. Referring to FIG. 1, an observer 20 views the bundle accumulator machine 10 from the feed end and is looking toward the output end of the machine as is indicated by an arrow 22. The right side of the bundle accumulator machine 10 is the observer's 20 right-hand side. The left side of the bundle accumulator machine 10 is the observer's 20 left-hand side. The procession of cartons 12 travel along a line from the feed end to the output end of the bundle accumulator machine 10. The longitudinal direction is parallel to this line of carton travel. The lateral direction is perpendicular to the longitudinal direction.

Figure 2:
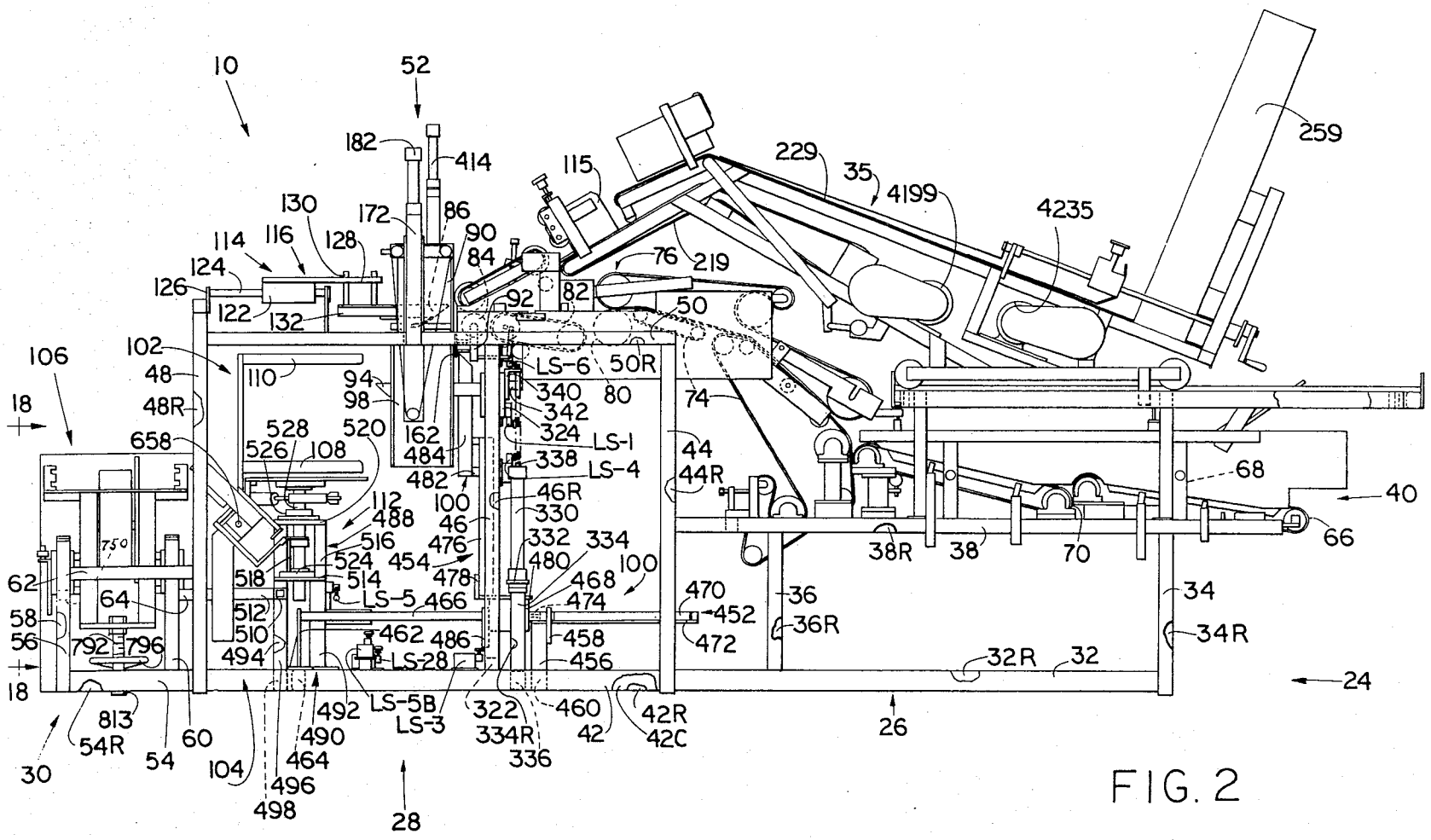
FIG. 2 is a side elevational view of the machine illustrated in FIG. 2.

Major assemblies of the bundle accumulator machine 10 are held in spaced relationship with each other by means of a basic framework 24 as indicated in FIG. 2. The basic framework 24 is comprised of three major subassemblies: a feed frame assembly 26, an elevator frame assemmbly 28, and a pushoff frame assembly 30.

The feed frame assembly 26 is comprised of a pair of bottom feed stringers 32 and 32R, which provide base support for a pair of input feed posts 34 and 34R and a pair of output feed posts 36 and 36R which in turn provide vertical spaced relationship for a pair of top feed stringers 38 and 38R. The pair of top feed stringers 38 and 38R provide mechanical support for the subassemblies of a feed conveyor assembly 40 to be hereinafter described in greater detail, and for a pad supplying assembly 35. Appropriate cross members (not shown in FIG. 2) provide fixed lateral spaced relationship between the right and left-hand sides of the feed frame assembly 26.

The elevator frame assembly 28 is comprised of a pair of bottom elevator stringers 42 and 42R, which provide base support for a pair of input elevator posts 44 and 44R, a mid-position longitudinal bottom elevator stringer 42C, a pair of elevator posts 46 and 46R, and a pair of output elevator posts 48 and 48R. These posts in turn provide mechanical support and spaced elevation for a pair of top elevator stringers 50 and 50R. The pair of top elevator stringers 50 provide an upper framework support for a stacking assembly 52. Appropriate cross members (not shown in FIG. 2) provide spaced lateral relationship between the right and left-hand sides of the elevator frame assembly 28. Specific cross members will be discussed in detail hereinafter.

The pushoff frame assembly 30 is comprised of a pair of bottom pushoff stringers 54 and 54R, which provide base support for an end corner post 56, an end slide post 58 and an input slide post 60. A pushoff bar 62 is horizontally and fixedly attached between the end corner post 56 and the left-side output elevator post 48. A short stringer 64 is horizontally fixedly attached between the input slide post 60 and the right-side output elevator post 48R. Appropriate cross members provide lateral spaced relationship between the right and left-hand sides of the framework. The three major frame assemblies are fixedly attached to each other to form the unitized basic framework 24.

Proper carton flow is of primary importance to the successful operation of the bundle accumulator machine 10. Starting at the feed end of the machine, an infeed conveyor 66 of the bundle accumulator machine 10 accepts the procession of cartons 12 (FIG. 1) as they move from the apron conveyor 14. The infeed conveyor 66 drives the procession of cartons 12 from their undersides, thus the procession of cartons 12 will continue in an overlapped or shingled manner. The procession of cartons 12 pass a discriminator assembly 68 (FIGS. 1 and 2) which includes upright plate means that is perpendicularly which provides a sufficient gap above the infeed conveyor 66 to assure that the thickness of the carbon stream that is allowed to pass does not exceed a manageable thickness. The procession of cartons 12 then passes to a discriminator conveyor 70. The discriminator conveyor 70 belt speed is faster than the speed of the infeed conveyor 66, thus the carton overlap will become less. This aids the procession of cartons 12 to become thinner and more uniform. A set of discriminator springs (not shown in detail) are flat spring fingers mounted above the discriminator conveyor 70 and can be adjusted to press the carton stream flat upon the conveyor. Proper discrimination of the cartons results in a properly shingled procession of cartons 12 at the input of an inclined conveyor 74. The inclined conveyor 74 carries the shingled cartons between its paired belts from the discriminator section to a counting section 76. The discriminator conveyor 70 and the incline conveyor 74 move at the same speed, thus the carton shingle produced by the discriminator section is preserved until after the carbons have passed over a count switch 78 (FIG. 1) located between a pair of count rollers 80 as can be seen in FIG. 2. The procession of cartons 12 is supported by the bottom belt of the inclined conveyor 74 until just before the count switch 78 is reached. As the cartons pass over the count switch 78, they are supported and driven by the count wheels 80. The top belt of the inclined conveyor 74 continues to hold the procession of carton 12 in proper spaced alignment until the count switch 78 has been passed. A carry-off conveyor 82 removes the counted cartons from the counting section 76 and feeds them into the throat of pairs of acceleration wheels 84. This combination of machinery quickly removes the cartons from the counting section 76 since the carry-off conveyor 82 runs considerably faster than does the incline conveyor 74. Also, the carry-off conveyor 82 does not stop during a packing cycle to insure that all counted cartons reach their intended stack. The pair of acceleration wheels 84 take the procession of cartons 12 from the carry-off conveyor 82 and drive them into the stacking assembly 52. The pair of acceleration wheels 84 are higher in speed than the carry-off conveyor 82 and do not stop during a pack cycle to insure that all counted cartons reach the stacking assembly 52. A detailed description of similar mechanical elements of the feed conveyor assembly 40 is presented in the aforementioned copending application Ser. No. 318,189, filed Dec. 26, 1972, and will not be further described hereinafter.

End pads (not shown in detail) for a stack can be delivered to the accelerator wheels 84 by the pad supplying assembly 35. Each end pad can be flat and can be of substantially the same shape and size as one of the cartons. An incline conveyor belt 229 delivers pads from a first pad hopper 259 to a front pad hopper 115. The incline conveyor belt 229 is driven by a motor 4235 by appropriate drive connections (not shown in detail). Pads accumulate in the front pad hopper 115 until an actuator 587 (FIG. 26) of a limit switch LS-14 is swung clockwise by the uppermost pad in the front pad hopper 115. Pads are advanced from the front pad hopper 115 by a nip conveyor belt 219 which is driven by a motor 4199 (FIG. 2) by drive connections not shown in detail which advances the lowermost pad in the front pad hopper 115 into engagement with a switch actuator 599 (FIG. 26) of a limit switch assembly LS-10-11 to swing the switch actuator 599 to the dot-dash position 599A of FIG. 26. When a pad is required, hydraulic fluid is directed to a cylinder 615 to draw a cylinder rod 619 downwardly and cause a yoke arm 629 to swing about a pivot 629A counterclockwise to cause a roll 581 rotatably mounted on the yoke arm 629 to grip an end portion of the leading pad against a roll 6629. The roll 6629 is driven by a belt 597, which is driven by the upper one of the acceleration rolls 84. The roll 6629 is driven counterclockwise and projects the lowermost pad between the acceleration rolls 84 in the manner described in the aforementioned Stapp et al. application Ser. No. 318,189. The switch actuator 599 is urged to the position shown in full lines by mechanism (not shown) of the limit switch assembly LS-10-11.

After the cartons 12 are counted, the cartons are moved by the carry-off conveyor 82 (FIG. 2) to the pair of acceleration wheels 84 which drive the cartons against a control arm 86 (FIGS. 3 and 4), thereby deflecting them downward into the stacking assembly 52. The leading edge of each carton impacts a carton stop assembly 88 (FIGS. 3A and 4), halting its longitudinal motion. As the cartons fall, they begin to form the stack of cartons 16A (FIG. 4) in an auxiliary elevator assembly 90. As the stack of cartons 16A builds up, the trailing edges of the cartons are vibrated by a patter assembly 92 (FIG. 2) to straighten the stack.

Figure 3:
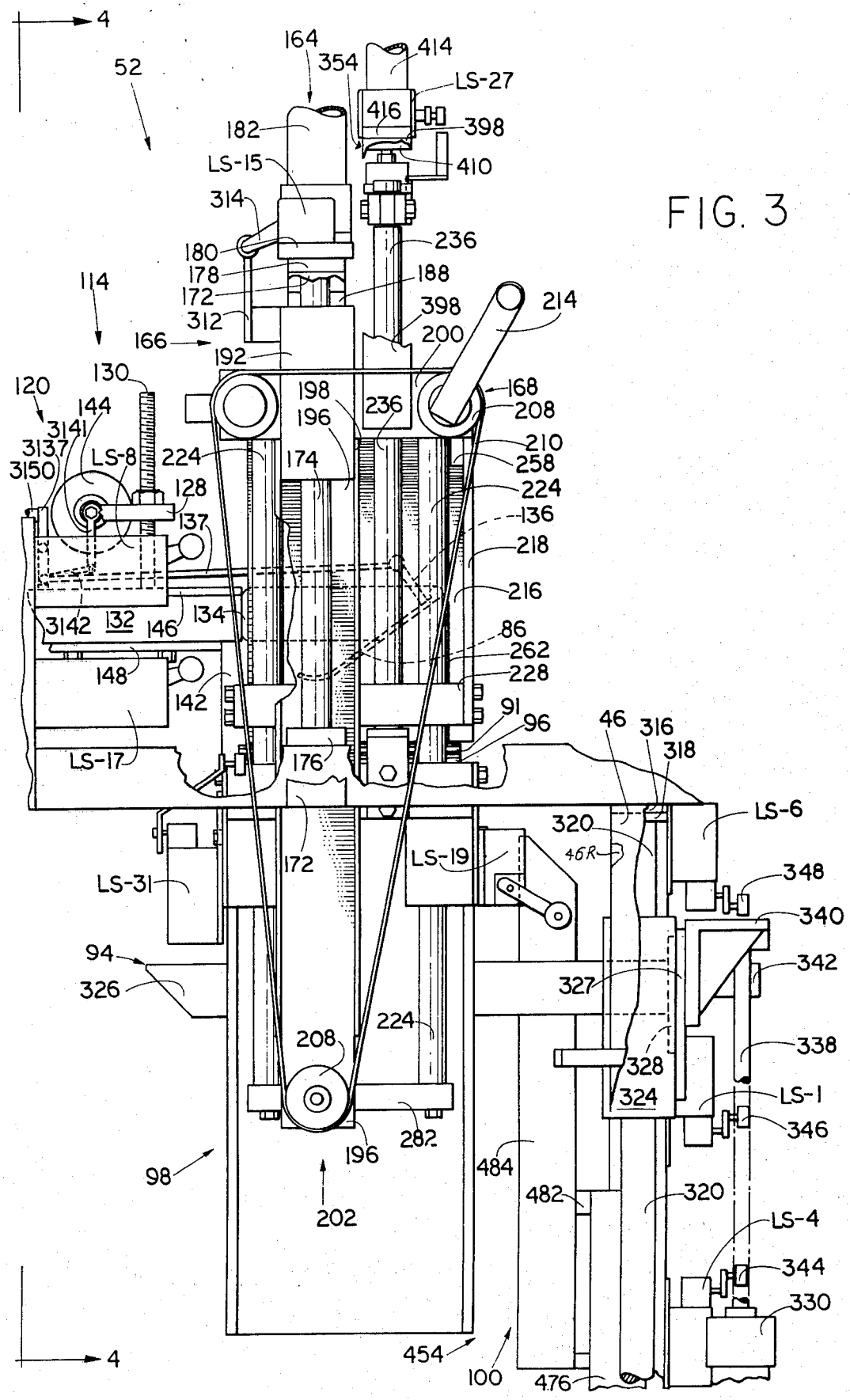
FIG. 3 is an enlarged fragmentary view in side elevation of a carton stack assembly station of the machine, parts being omitted or broken away for clarity.
Figure 4:
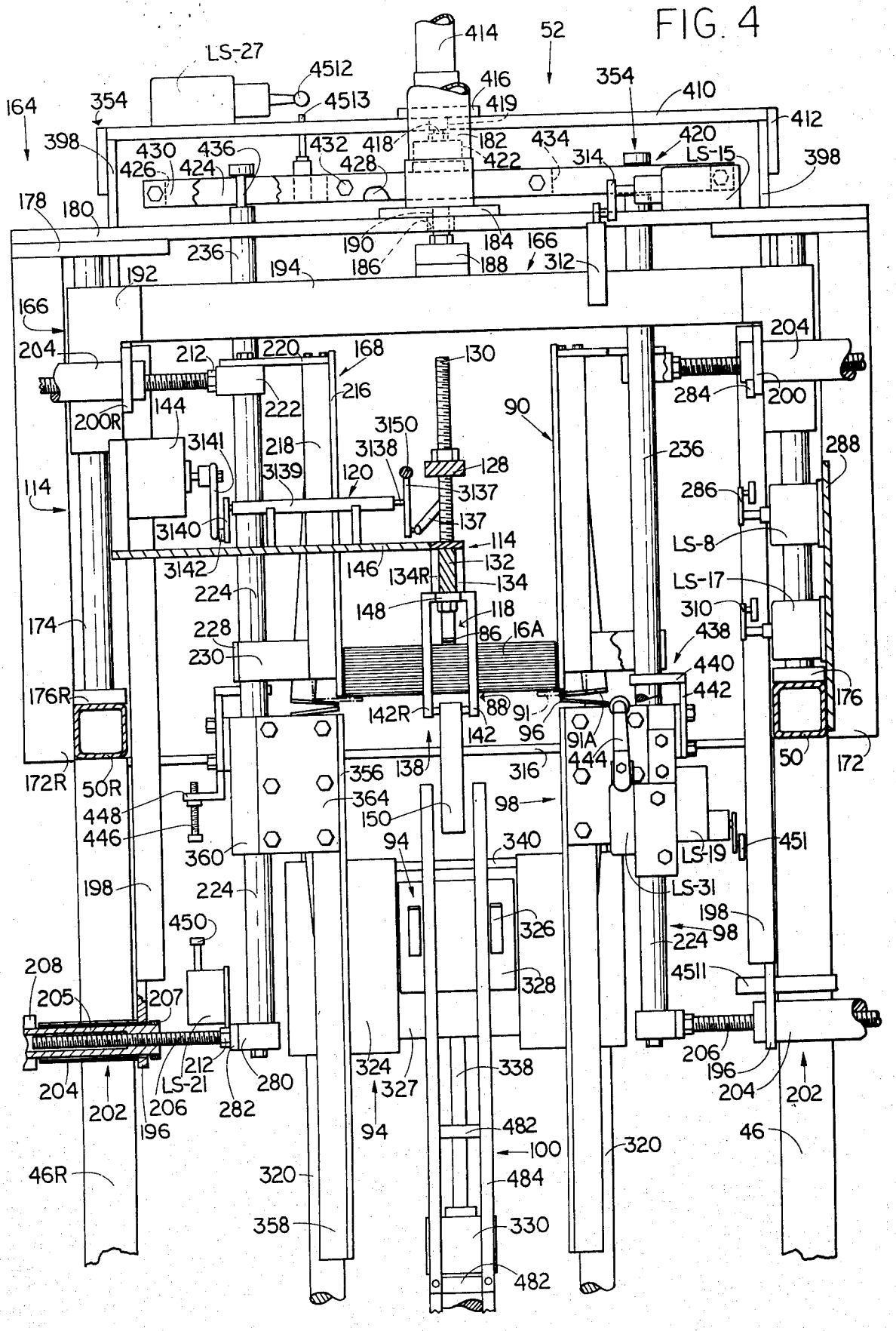
FIG. 4 is a view in section taken on the line 4—4 in FIG. 3, flaps of an auxiliary elevator assembly being shown in stack supporting position in dot-dash lines and in retracted position in full lines.

The auxiliary elevator assembly 90 is slowly lowered under control of a hydraulic feed or microtorque valve 144 (FIG. 3) as cartons are fed onto a pair of flaps 92 (see FIGS. 3 and 4), the flaps being shown in stack supporting position in dot-dash lines in FIG. 4. When the auxiliary elevator assembly 90 reaches its full down position, the pair of flaps are opened to the full line position shown at 91A, thereby transferring the stack of cartons 16 to a main elevator assembly 94. The hydraulic feed valve slowly lowers the main elevator assembly 94 as cartons continue to be fed onto the stack. The auxiliary elevator assembly 90 with its pair of flaps 91 open moves in rapid traverse to its up position in preparation for another cycle. When the count switch 78 (FIG. 1) reaches its preset limit and the desired number of cartons are on the stack, the infeed conveyor 66 (FIG. 2), the discriminator conveyor 70 and the incline conveyor 74 are stopped, thus stopping the feed of additional cartons to the counter section 76. The carry-off conveyor 82 continues to run so that all of the counted cartons are fed to the stacking assembly 52. The main elevator assembly 94 now moves down in rapid traverse to the bottom of its stroke. A pair of compressor flaps 96 (FIGS. 3 and 4) associated with a compressor assembly 98 (FIGS. 2 and 3) close over the top of the stack of cartons 16. The compressor assembly 98 moves down, decreasing the stack height to the desired dimension. At this time the pair of flaps 91 (FIG. 4) of the auxiliary elevator assembly 90 close and the infeed conveyor 66 (FIG. 2), the discriminator conveyor 70 and the incline conveyor 74 are started to again feed cartons into the auxiliary elevator assembly 90. A vertical stack pusher assembly 100 advances toward the output end of the bundle accumulator machine 10 and moves the stack of cartons 16 from the stacking assembly 52, and in particular off the main elevator assembly 94 into a basket assembly 102 (FIG. 2). The compressor assembly 98 then moves up to its full up position to wait for its next cycle. The vertical stack pusher 100 now retreats to its previous position and also waits for another cycle. The main elevator assembly 94 moves up in rapid traverse to its full up position and the pair of flaps 96 FIG. 4) of the compressor assembly 98 are opened for another cycle.

The basket assembly 102 can receive cartons in either of two positions, depending on the size of the carton. Smaller size cartons are received by the basket in a no turn position as can be seen in FIG. 2. After receiving the stack of cartons 16, the basket assembly 102, which is in an upright position, rotates through an arc of 90° about the axis of a tip shaft 658 by means of a tipover assembly 104 to a horizontal position in front of a pushoff assembly 106. The pushoff assembly 106 then moves the stack of cartons 16 laterally and to the left into the cassette receiver 18 (FIG. 1) of the bundle overwrap machine or other appropriate customer device. The cassette receiver 18 can be an enclosed device (not shown in detail) with one open side for the reception of the stack of cartons 16 that now has its stack height in the horizontal plane. This will now be termed the output stack length. The individual cartons, which were delivered to the stacking assembly 52 in the horizontal plane, now extend in the vertical transverse plane. Also, the carton length was parallel to the longitudinal direction. Therefore, the individual carton length has now become the output stack height. The output stack length is determined by the distance between a basket bottom 108 (FIG. 2) and a basket top 110 of the basket assembly 102 (see FIG. 2). The basket bottom 108 and the basket top 110 are similar in construction and details of only the basket bottom 108 will be described in detail hereinafter. The output stack length dimension is a constant. In cases where the output height dimension or individual carton length becomes of sufficient magnitude that the stack of cartons 16 will not clear the top of the cassette receiver 18, then the output stack must be turned over on its side so that the width of the individual carton will become the output stack height and thereby permit entry. This is achieved by a turn box assembly 112 which supports the tipover assembly 104 and the basket assembly 102. In such cases, the basket assembly 102 and the tipover assembly 104 are rotated 90° counterclockwise when viewing the bundle accumulator machine 10 from above as in FIG. 1. The stack of cartons 16 will now enter the side of the basket assembly 102 (FIG. 2). This is the turn mode of the basket assembly 102. After reception of the stack of cartons 16, the basket assembly 102 rotates 90° clockwise, positioning the individual carton length in the lateral direction. As the basket assembly 102 is tipped over to the horizontal position in front of the pushoff assembly 106, the individual carton width will now become the output stack height. Entry into the cassette receiver 18 is not possible as is the processing of larger cartons.

As the pushoff assembly 106 recycles, a start signal is sent to the bundler overwrap machine (not shown in detail) of which the cassette receiver 18 is a part, which clears the cassette receiver 18. The basket assembly 102 now returns to its vertical position shown in FIG. 2. If the basket assembly 102 is operating in the turn mode, the basket will then rotate counterclockwise 90° and wait for another cycle. When the auxiliary elevator assembly 90 reaches its fully down position, the pair of flaps 91 (FIG. 4) will open to transfer another stack of cartons 16 to the main elevator assembly 94 to start another packing cycle. A detailed description of the mechanical elements of each assembly will be hereinafter described.

CARTON STOP AND STACK CONTROL ASSEMBLY

After the procession of cartons 12 (FIG. 1) are counted, the cartons are quickly moved by the carry-off conveyor 82 to the pair of acceleration wheels 84 which drive the cartons under the control arm 86 (FIGS. 2 and 3) which deflects them nose down into the stacking assembly 52. The stacking assembly 52 includes a stack control assembly 114 comprised of three subassemblies: a mounting arrangement 116 (FIG. 2), a control arm assembly 118 (FIG. 4), and a microtorque assembly 120 (FIG. 3).

The mounting arrangement 116 is comprised of a pair of slide blocks 122 (FIG. 2) for longitudinal adjustment of the control arm assembly 118 (FIG. 4), a pair of slide rods 124 (FIG. 2) that provide mechanical support thereof, and a set of four rod mounts 126 that fixedly attach the pair of slide rods 124 to the pair of top elevator stringers 50 and 50R and the pair of output elevator posts 48 and 48R (see FIG. 2).

Figure 3A:
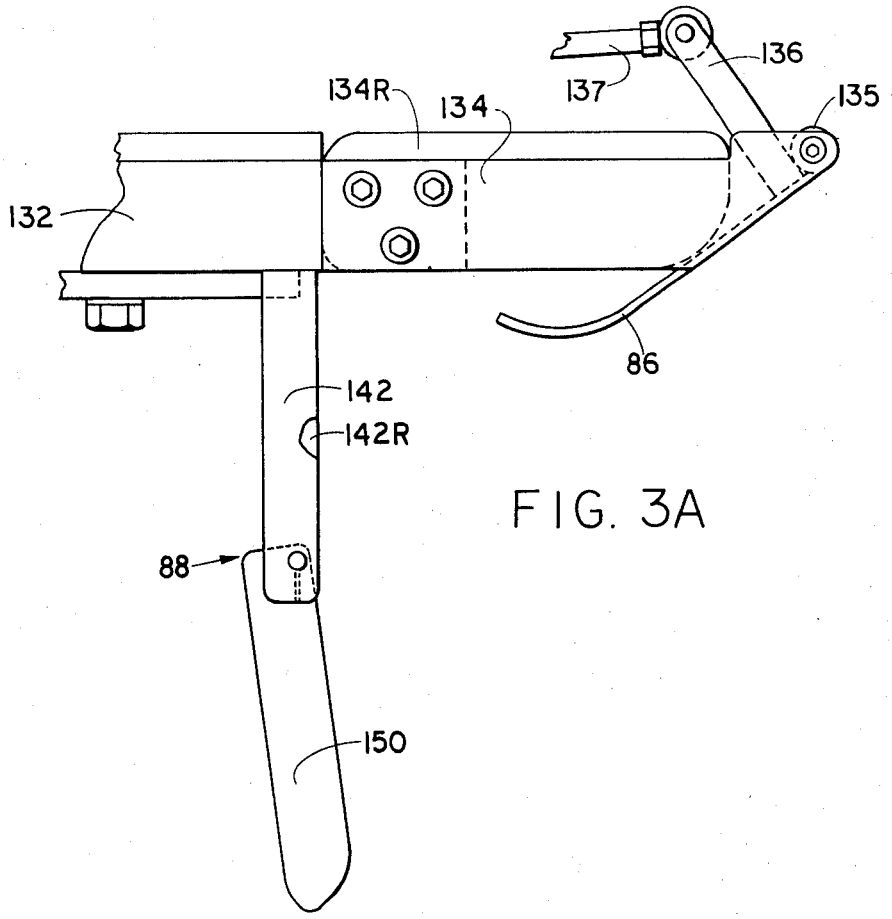
FIG. 3A is a fragmentary view in side elevation showing details of a stack control arm and a carton stop assembly of the machine.

Vertical adjustment reference is provided by a mounting boom 128 that is fixedly attached to the pair of slide blocks 122. Threadably mounted in the mounting boom 128 is a pair of vertical adjusting screws 130 in longitudinal alignment with each other, that provide vertical adjusting support for a mount plate 132. As shown in FIG. 3A, the carton stop assembly 88 is mounted on the mount plate 132. The mount plate 132 provides mechanical support for a close control body plate 134 (FIG. 3). Rotatably mounted on the plate 134 is a rocker lug 135 (FIG. 3A) on which the control arm 86 is mounted. A crank 136 which swings with the rocker lug 135 is pivotally connected to a link 137 (FIG. 3). The control arm 86 rides on top of the stack of cartons 16A (FIG. 4) and turns the cartons nose down into the stacking assembly 52 (FIG. 2) to prevent pitchup and disorientation of the cartons. The crank 136 (FIG. 3) and the link 137 provide a link to the microtorque assembly 120. The microtorque assembly 120 is comprised of an assemblage of rods, pivot arms, and bearings that permit a semiremote placement of the microtorque valve 144 outside the stacking assembly 52. The microtorque assembly 120 and the microtorque valve 144 are fixedly attached to a stack control mount frame 146 (FIG. 4). The stack control mount frame 146 is rigidly attached to the mount plate 132 and extends toward the right side of the bundle accumulator machine 10. The microtorque valve 144 is a rate control valve governing the descent speed of the auxiliary elevator assembly 90 and the main elevator assembly 94. Movement of the link 137 swings a crank 3137 (FIGS. 3 and 4). The crank 3137 is mounted on a shaft 3138 (FIG. 4) rotatably mounted on a sleeve 3139. The shaft 3138 turns a crank 3140. The crank 3140 is linked to an operator arm 3141 of the microtorque valve 144 by a link 3142 (FIG. 3) so that, as the control arm 86 rises and falls, the operator arm 3141 is swung to the right or left as shown in FIG. 3. As shown in FIG. 3, an upper end of the crank 3137 can engage a stop 3150 which limits counterclockwise swinging of the crank 3137. The stop 3150 is supported on an appropriate frame, not shown in detail.

The carton stop assembly 88 (FIG. 4) is comprised of carton stop arms 142 and 142R fixedly attached to a card stop mount 148. The card stop mount 148 is fixedly attached to the bottom of the mount plate 132 of the stack control assembly 114. The card stop arms 142 and 142R stop the longitudinal movement of the cards entering the stacking assembly 52. A pendulum retainer 150 is pivotally mounted at the bottoms of the card stop arms 142 and 142R and helps retain the stack of cartons 16 in vertical alignment while the main elevator assembly 94 descends to its full down position. As the vertical stack pusher assembly 100 (FIG. 2) begins to move the stack of cartons toward the basket assembly 102. the pendulum retainer 150 (FIG. 4) will swing upward, permitting the stack of cartons 16 to pass under it. In so doing, the pendulum retainer 150 holds the stack of cartons 16 against the vertical stack pusher assembly 100, thereby preventing the stack of cartons 16 from spilling forward before it is inserted into the basket assembly 102 (FIG. 2).

The carton stop arms 142 and 142R stop the forward longitudinal movement of the cartons entering the stacking assembly 52. The individual cartons may rebound a slight amount as they come to rest in the auxiliary elevator assembly 90. To establish acceptable vertical alignment of the forming stack of cartons, a patter plate 162 of the patter assembly 92 jostles the trailing edges of the cartons against the card stop arms 142. The patter plate 162 is moved longitudinally by a pivot and cam arrangement attached to the assemblies associated with the pairs of acceleration wheels 84 (not shown in detail) and the carry-off conveyor 82 respectively.

AUXILIARY ELEVATOR ASSEMBLY

The auxiliary elevator assembly 90 is comprised of four subassemblies; a mounting assembly 164 (FIG. 3), a yoke assembly 166, a pair of side guide assemblies 168 (FIGS. 5 and 6), and a pair of flap assemblies 170 (FIG. 6). The auxiliary elevator assembly 90 (FIG. 2) receives individual cartons as they are discharged from the pair of acceleration wheels 84 and collects them into an incomplete stack. The auxiliary elevator speeds the production output of the bundle accumulator machine 10 by permitting the starting of a second stacking and counting cycle before the remainder of the bundle accumulator machine 10 has completed processing of a first advancing stack of cartons.

The mounting assembly 164 (FIGS. 3 and 4) comprises a pair of auxiliary elevator posts 172 and 172R fixedly attached to the outside of the pair of top elevator stringers 50 and 50R, respectively, and constitute the main structural support of the auxiliary elevator 90. The pair of elevator posts 46 and 46R (FIG. 2) and the pair of auxiliary elevator posts 172 and 172R are not in longitudinal alignment. A pair of upright auxiliary elevator shafts 174 (FIG. 4) are supported by a pair of lower shaft retainers 176 and 176R that are fixedly attached at the intersection of the pair of top elevator stringers 50 and 50R and the pair of auxiliary elevator posts 172 and 172R and a pair of upper shaft retainers 178 that are rigidly fixed to the top of the pair of auxiliary elevator posts 172 and 172R. The pair of auxiliary elevator shafts 174 function as vertical guideways for the auxiliary elevator assembly 90. A cylinder mount plate 180 extends laterally and is fixedly attached across the top of the pair of upper shaft retainers 178. An auxiliary elevator cylinder 182 is fixedly attached to the cylinder mount plate 180 by means of a cylinder face plate 184. An auxiliary elevator cylinder rod 190 extends through a hole 186 in the cylinder mount plate 180 and couples, by means of a cylinder block 188, to the auxiliary yoke assembly 166. The auxiliary elevator cylinder 182 provides vertical motive power to the auxiliary elevator assembly 90 under the rated ccontrol of the microtorque valve 144 (FIG. 3).

The yoke assembly 166 (FIG. 4) of the auxiliary elevator assembly 90 comprises a pair of auxiliary elevator slide blocks 192 that are slidably mounted on the elevator shafts 174 provide the vertical degree of freedom to the auxiliary elevator assembly 90. The yoke assembly 166 also comprises a horizontal yoke member 194 that functions as an actuator bar in cooperation with the cylinder block 188 of the auxiliary elevator cylinder rod 190. A pair of horizontal side guide mounts 200 and 200R are fixedly attached to the pair of auxiliary elevator slide blocks 192. Also rigidly affixed to the pair of auxiliary elevator slide blocks 192 is a pair of vertical yoke members 196. A pair of vertical stiffeners 198 are rigidly attached to each of the pair of vertical yoke members 196 to provide structural strength thereto. The pair of vertical stiffeners 198 also provide structural strength to each of the intersections formed by abutment of the pair of vertical yoke members 196 against the bottom edge of the pair of horizontal side guide mounts 200, thereby forming a pair of T-shaped mounting frames as can be seen in FIG. 3.

The pair of side guide assemblies 168 provides a set of six lateral adjusting assemblies 202 that are identical in structure. A lateral adjusting assembly is mounted at each end of the pair of T-shaped mounting frames as shown in FIG. 3. One of the lateral adjusting assemblies 202 is shown in section in FIG. 4. Each of the set of six lateral adjusting assemblies 202 provides a side guide bearing 204 that is rigidly fixed to its associated mounting member 196 or 100. A shaft nut 205 is rotatably held in the side guide bearing 204. A sprocket wheel 208 is fixedly attached to the outer extremity of the shaft nut 205 and a retainer collar 207 is fixedly attached to the inner extremity of the shaft nut 205. A side guide adjusting screw 206 is threadably mounted through the shaft nut 205. Therefore, by rotating the sprocket wheel 208 and the shaft nut 205 combination, a lateral non-rotating motion is imparted to the side guide adjusting screw 206. The inner extremity of the side guide adjusting screw 206 is fitted with a jam nut 212 that is fixedly attached to its respective mount to be discussed hereinafter. A chain 210 (FIG. 3) circumscribes the three sprocket wheels associated with each of the pairs of T-shaped mounting assemblies and causes all three adjusting screws to be equally moved when a crank 214, that is fixedly attached to one of the sprocket wheels, is turned. This arrangement permits lateral movement of the pair of side guide assemblies 168 to cooperate with different carton sizes.

Each of the pair of side guide assemblies 168 also provide (FIGS. 5, 6 and 7) an auxiliary elevator side guide plate 216 that is fixedly mounted to a pair of side guide braces 218 and a top plate 220. Fixedly attached to the underside of the top plate 220 is a pair of upper rod mounts 222 for retaining the top end of a pair of compression slide rods 224. With respect to the auxiliary elevator assembly 90, the pair of compressor slide rods 224 function as mounting posts only. The bottom of the auxiliary elevator side guide plate 216 is held in rigid spaced relationship with the pair of compressor slide rods 224 by an assembly which includes a pair of lower rod blocks 226. The pair of lower rod blocks 226 are held in longitudinal spaced relationship by a rod brace 228 that is mounted on its output end by an output rod bracket 230 and on its input end by an input rod bracket 232 and a spacer 234. The output rod bracket 230 and the input rod bracket 232 with the spacer 234 are fixedly attached to the pair of side guide braces 218. A compressor push rod 236 passes through a rod hole 238 in the top plate 220 and extends vertically downward to the compressor assembly 98 (see FIG. 4).

Each of the pair of side guide assemblies 168 (FIGS. 5, 6 and 7) function as mounting assemblies for the pair of flap assemblies 170 (FIG. 6). A cylinder swivel mount 240 is fixedly attached to the top plate 220 by a pair of bolts 242. The cylinder swivel mount 240 is positioned over a lug hole 241 (FIG. 7). A swivel pin 244 passes fixedly through holes in the cylinder swivel mount 240 and pivotally through a hole in a cylinder mount lug 246. The cylinder mount lug 246 is rigidly fixed to a cylinder mount assembly 248 (FIGS. 5 and 6). A flap cylinder 250 is fixedly attached to the cylinder mount assembly 248. The end of a flap cylinder rod 252 is threaded into a flap rod lug 254 and held securely in place by a lug jam nut 256. A pair of flap pivot mounts 258 (FIG. 5) are fixedly attached on the inside of the pair of side guide braces 218. Theadably mounted in the pair of flap pivot mounts 258 is a pair of pins 260. Rotatably mounted on the pins 260 is a pair of vertical yoke members 262 that extend downwardly and are held in longitudinal fixed relationship with each other by a flap yoke mount 264. One of the pair of flaps 92 is fixedly attached to the bottom of the flap yoke mount 264. Fixedly mounted to the top of the flap yoke mount 264 is a flap block 266, which, in combination with the flap rod lug 254, forms the mounting system for the cylinder and flap actuator coupling. The coupling comprises a pair of outer flap links 279 that are pivotally mounted on a link block pin 272 and a lug pin 274. Also, a pair of inner flap links 276 are pivotally mounted on the lug pin 274 and a flap block pin 278 to form a scissor link system which transforms the flap cylinder rods 252 near vertical linear movement into a near horizonal movement of each of the pair of flaps 91. As both flap cylinders 250 expand, the pair of flaps 91 move inward to support a forming stack of cartons as shown in FIG. 4.

The pair of compressor slide rods 224 that are fixedly held in the pair of upper rod mounts 222 extend downwardly and terminate in a pair of lower rod mounts 280 (FIG. 4). The pair of lower rod mounts 280 are held in longitudinal spaced relationship with each other by a lower mount brace 282. The jam nut 212 associated with each of the pair of bottom lateral adjusting assemblies which are encountered at the bottom of the T-shaped mounting frames is fixedly attached to the lower mount brace 282. The upper set of four lateral adjusting assembly jam nuts 212 are fixedly attached to the two pairs of upper rod mounts 222.

The stacking assembly 52 receives individual cartons as they are discharged from the pair of acceleration wheels 84 (FIG. 2) that drive the cartons into the auxiliary elevator assembly 90. The cartons are deflected downward by the control arm 86 and come to rest against the card stop assembly 88 (FIGS. 3A and 4). The cards are now resting on the pair of flaps 91 of the auxiliary elevator assembly 90. They are also slightly wedged under the control arm 86 which signals the microtorque switch 144 to lower the auxiliary elevator assembly 90 sufficiently to permit the reception of more cartons in procession. Therefore, the auxiliary elevator assembly 90 descends in rated manner as a stack of cartons 16A (FIG. 4) forms. As the auxiliary elevator assembly 90 descends a limit switch trip 284 mounted on the horizontal side guide mount 200 depresses a limit switch arm and roller 286 of a limit switch LS-8. The limit switch LS-8 is fixedly attached to a vertical mount plate 288 that is fixedly attached to the left side top elevator stringer 50. If the overall circuit indicates that the vertical stack pusher assembly 100 (FIG. 2) is not in its full back position, then the limit switch LS-8 will operate an electrical circuit to be described hereinafter to shut down all infeed machinery to prevent an interference between the vertical stack pusher assembly 100 and the stack of cartons. If the verical stack pusher assembly 100 is full back, then the switch LS-8 will be bypassed and the auxiliary elevator assembly 90 will continue its descent while cartons continue to be received. As the limit switch trip 284 (FIG. 4) depresses a switch arm and roller 310 of a limit switch LS-17 that is fixedly attached to the vertical mount plate 288, the limit switch LS-17 will make the appropriate circuit and stop the descent of the auxiliary elevator assembly 90. The limit switch LS-17 causes opening of the pair of flaps 91 to the position shown in full lines in FIG. 4 at 91A, thereby dropping the partial stack of cartons 16 onto the main elevator assembly 94. The circuitry of the limit switch LS-17 also causes the auxiliary elevator assembly 90 to return to its full up position in rapid traverse with the pair of flaps 91 open. A limit switch trip 312 is mounted on the horizontal yoke member 194. As the auxiliary elevator assembly 90 returns to its full up position, the trip 312 contacts a switch arm and roller 314 of a limit switch LS-15. This makes the associated circuit and stops the auxiliary elevator 90 and its pair of flaps 91 remain open. The limit switch LS-15 is fixedly mounted to the cylinder mount plate 180 of the mounting assembly 164.

The main elevator assembly 94 accepts the partial stack of cartons 16 from the auxiliary elevator assembly 90 and continues to accumulate cartons in stacked fashion as the main elevator assembly 94 descends in rated manner under control of the microtorque valve 144 (FIG. 3). The vertical descent of the main elevator is stopped by a bottom limit switch LS-4 (FIG. 2) to be discussed hereinafter.

MAIN ELEVATOR ASSEMBLY

The main elevator assembly 94 comprises a main elevator top mount plate 316 as can be seen in FIGS. 3 and 4. A pair of top rod mounts 318 (FIG. 3) are carried by the mount plate 316 and are fixedly attached to main elevator slide rods 320. The pair of main elevator slide rods 320 are fixedly attached to a main elevator bottom cross member 322 (FIG. 2) by means of a pair of bottom rod mounts not shown, but in similar manner as that of the pair of top rod mounts 318. A pair of main elevator slide blocks 324 slidably mounted on the slide rods 320 provide the vertical degree of freedom to the main elevator assembly 94. A slide block lateral brace 327 (FIG. 3) fixedly holds the pair of main elevator slide blocks 324 in parallel alignment. A pair of main elevator arms 326 are perpendicularly fixed to an elevator arm mount 328 (FIG. 4) that is in turn fixedly attached to the output side of the slide block lateral brace 327. The pair of main elevator arms 326 support the forming stack of cartons. The main elevator assembly 94 is raised and lowered by a main elevator cylinder 330 (FIGS. 2 and 3). The main elevator cylinder 330 is fixedly attached to a bottom mount plate 332 that is horizontally and rigidly fixed across the top of a pair of vertical mount posts 334 and 334R. The vertical mount posts 334 and 334R are fixedly attached to a cylinder cross member 336. A main elevator cylinder rod 338 of the main elevator cylinder 330 attaches to a main elevator cylinder and mount 340, which in turn is fixedly attached to the infeed side of the slide block lateral brace 327, as shown in FIG. 3.

The main elevator assembly 94 accepts the partial stack of cartons 16 from the auxiliary elevator assembly 90 and continues to accumulate cartons in stacked fashion as the main elevator assembly 94 descends in rated manner under control of the microtorque valve 144. The number of cartons received by the stack of cartons 16 is primarily controlled by the count switch 78 (FIG. 1) of the feed conveyor assembly 40 (FIG. 2). When the count switch 78 reaches its preset number, it energizes the appropriate circuit to be described hereinafter and shuts down the feed conveyor assembly 40 and, after a time delay to permit the last cartons to reach the stacking assembly 52, causes lowering of the main elevator assembly 94 by means of the main elevator cylinder 330 in rapid traverse to its full down position. The full down position is achieved when a limit switch trip 342 (FIGS. 2 and 3), that is fixedly attached to the right side member of the pair of main elevator slide blocks 324, depresses a switch arm and roller 344 of a limit switch LS-4. A manual selector switch can be set so that the count switch 78 is bypassed. That is, the main elevator assembly 94 will continue to receive cartons until the limit switch trip 342 depresses a switch arm and roller 346 (FIG. 3) of a limit switch LS-1. As before, the fed conveyor assembly 40 is shut down and, after a time delay, the main elevator assembly 94 descends in rapid traverse until it reaches the limit switch LS-4, which stops its vertical descent. The limit switch LS-4 also makes the circuit that causes closing of the pair of flaps 91 (FIG. 4) of the auxiliary elevator assembly 90, and the pair of compressor flaps 96. After the compressor assembly 98 (FIG. 2) and the vertical stack pusher assembly 100 complete their cycles, the main elevator assembly 94 is signalled to move up in rapid traverse until the limit switch trip 342 depresses a switch arm and roller 348 (FIG. 3) of a limit switch LS-6 that makes the circuit and stops the main elevator assembly 94. The limit switch LS-6 also sets up the appropriate circuit in preparation for another cycle.

COMPRESSOR ASSEMBLY

Figures 8, 9, 10:
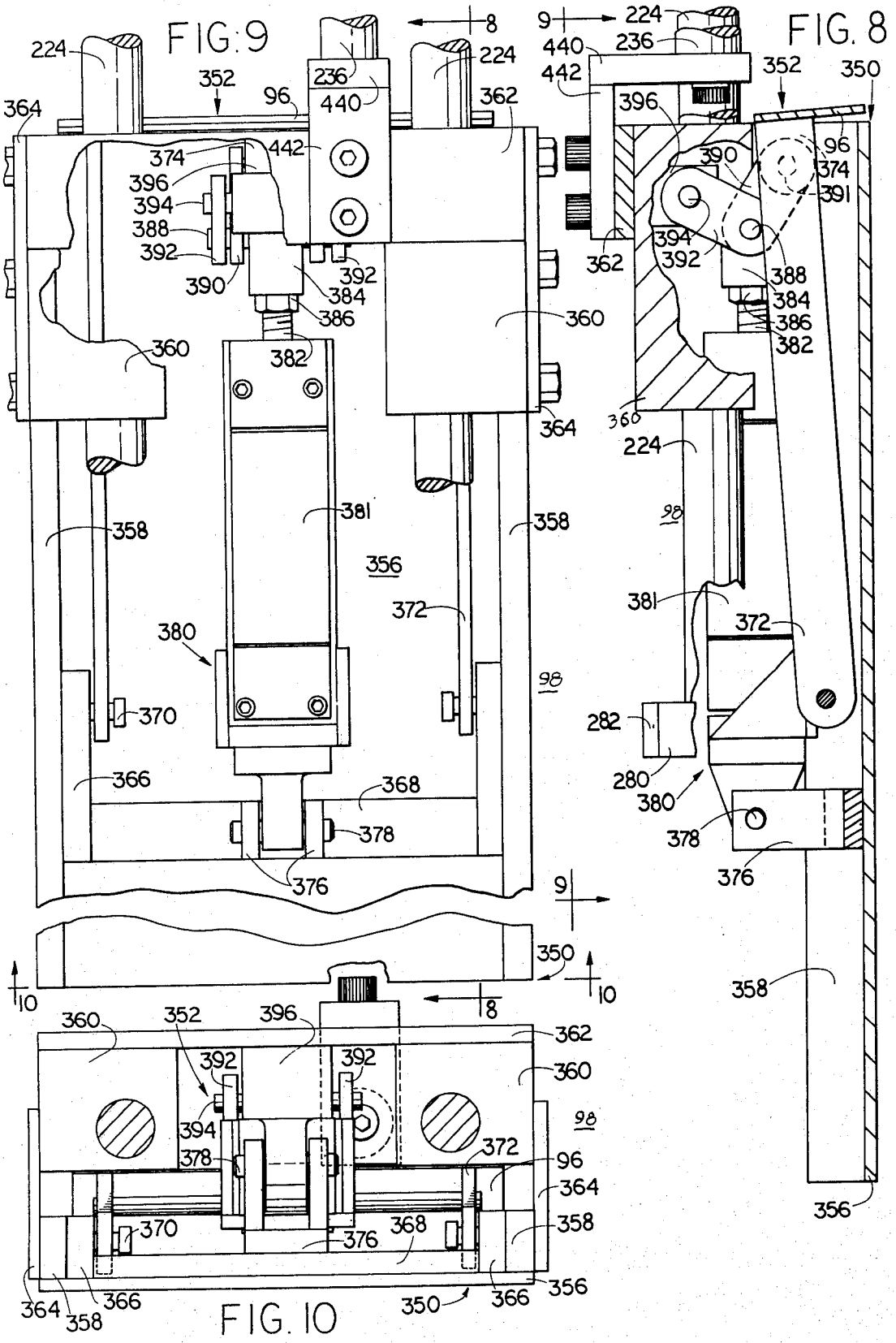
FIG. 8 is a fragmentary view in section on an enlarged scale showing compressor assembly details and taken on the line 8—8 in FIG. 9.
FIG. 9 is a view looking in the direction of the arrows 9—9 in FIG. 8.
FIG. 10 is a view in section taken on the line 10—10 in FIG. 9.

Details of the compressor assembly 98 are shown in FIGS. 8, 9 and 10. The compressor assembly 98 comprises a pair of compressor side guide assemblies 350, one of which is shown in FIG. 8, a pair of compressor flap assemblies 352, and a compressor yoke assembly 354 (FIG. 4). One of the pair of compressor side guide assemblies 350 (FIG. 8) is comprised of a compressor side guide plate 356 that is fixedly attached to a pair of compressor side guide braces 358. A pair of compressor slide blocks 360 are held in vertical alignment by a slide block brace 362 and are held in spaced relationship with the pair of compressor side guide braces 358 by a pair of slide block mounting members 364.

One of the pair of compressor flap assemblies 352 comprises a pair of compressor pivot mounts 366 (FIG. 10) fixedly attached in a parallel manner to the pair of compressor side guide braces 358. A flap mount brace 368 is fixedly attached between the pair of compressor pivot mounts 366 and also functions as a longitudinal mounting member for the compressor side guide plate 356. A pair of yoke pins 370 are threadably mounted in the upper portion of the pair of compressor pivot mounts 366 and pivotally hold a pair of flap yoke members 372 in near vertical position. The upper ends of the pair of flap yoke members 372 are held in parallel alignment with each other by one of the pair of compressor flaps 96 fixedly attached thereto. Centrally located on the underside of each of the pair of compressor flaps 96 is a flap actuator block 374 (FIG. 9).

Centrally located and fixedly attached to the flap mount brace 368 is a yoke cylinder pivot mount 376. Laterally and fixedly held in the mount 376 is a cylinder mount pin 378 that pivotally holds the lug of a compressor cylinder mount assembly 330. Fixedly attached to the compressor cylinder mount assembly 380 is a compressor cylinder 381. Extending upwardly from the compressor cylinder 381 is a compressor push rod 382, having a rod lug 384 threadably mounted to the end thereof and locked into place by a jam nut 386. Fixedly and longitudinally placed through the end of the rod lug 384 is a lug pin 388. Pivotally mounted to the lug pin 388 approximate to the rod lug 384 is a pair of inner flap links 390 (FIG. 8) that are pivotally mounted on a pin 391 that is firmly and longitudinally held in the flap actuator block 374. A similar pair of outer flap links 392 are pivotally held on the outer sections of the lug pin 388 and pivotally connect to a link block pin 394 that is firmly held in a link block 396 that is in turn fixedly attached to the inside surface of the slide block brace 362.

The pair of slide block 360 are movably mounted on the pair of compressor slide rods 224. As can be seen in FIG. 4, the compressor assembly 98 is controlled in vertical movement by the compressor yoke assembly 354. The compressor yoke assembly 354 comprises a pair of vertical mount supports 398 that are fixedly attached to the pair of horizontal side guide mounts 200 and 200R. (See FIGS. 3 and 4.) Fixedly attached across the top of the pair of vertical mount supports 398 is a compressor cylinder mount plate 410 (FIG. 4) and a pair of end plates 412 fixedly securing the ends of the compressor cylinder mount plate 410 to the pair of cylinder mount supports 398. A compressor cylinder 414 is fixedly mounted to the compressor cylinder mount plate 410 by means of a cylinder mount plate 416. A compressor cylinder rod 418 of the compressor cylinder 414 extends through a hole 419 in the compressor cylinder mount plate 410 and is fixedly attached to a yoke cross member 420 by means of a compressor rod block 422. The yoke cross member 420 is comprised of back plate 424, a pair of end spacers 426 and a center spacer 428 that are fixedly attached to the back plate 424. Bolted to the face of the pair of end spacers 426 and the center spacer 428 is a top plate 430 fixedly attached by means of a set of four bolts 432 in such manner to form a pair of slots 434. The pair of compressor push rods 236 are provided with milled upper ends 436 of smaller diameter that pass through the pair of slots 434. This arrangement of parts prevents each compressor push rod 236 from vertical movement with respect to the yoke cross member 420, but does provide a lateral degree of freedom to cooperate with the lateral adjustment of the set of six lateral adjusting assemblies 202. The lower ends of the compressor push rods 236 are fixedly attached to a pair of push rod brackets 438. Each of the pair of push rod bracket 438 is comprised of a top fastener plate 440 fixedly attached at right angles to a vertical mount piece 442 that is fixedly attached to the outside surface of the slide block brace 362 (FIG. 8) of the compressor assembly 98.

As the main elevator assembly 94 reaches its full down position, the limit switch LS-4 (FIG. 3) makes the proper circuit and causes the pair of compressor flaps 96 (FIG. 4) to close over the stack of cartons. Referring to FIG. 4, one of the pair of compressor flaps 96 releases a switch arm and roller 444 of a limit switch LS-31 that makes the appropriate circuit that causes the compressor cylinder 414 to extend its compressor cylinder rod 418. Therefore, the compressor yoke assembly 354, that is fixedly attached to each of the compressor assemblies 98, is moved downwardly to reduce the height of the stack of cartons to its minimum preset dimension. A limit switch trip 446 is threadably and vertically mounted in an angle bracket 448 that is in turn fixedly attached to the side of the right hand member of the pair of compressor slide blocks 360. (See FIG. 4.) As the compressor assembly 98 approaches its full down position, the limit switch trip 446 depresses a plunger 450 of a limit switch LS-21 that is mounted to the lower mount brace 282. When the compressor assembly 98 reaches its full down position, a limit switch actuator 451 of a limit switch LS-19, which moves with the compressor assembly, engages an actuator 4511 mounted on the frame 46 to indicate the compressor assembly 98 is fully down. When the compressor assembly is fully up, a limit switch actuator 4512 of a limit switch LS-27 is energized by a rod actuator 4513 carried by the yoke cross member 420. The limit switches LS-19, LS-21, and LS-27 set up circuits that permit other assemblies and optional equipment to begin their respective cycles. The operation of pertinent assemblies will be described hereinafter.

FIRST STACK PUSHER ASSEMBLY

The vertical stack pusher assembly 100 is shown in FIGS. 2 and 3. The vertical stack pusher assembly 100 is comprised of a horizontal slide assembly 452 (FIG. 2) and a vertical pusher assembly 454. The horizontal slide assembly 452 (FIG. 2) is comprised of infeed central post 456 that is fixedly attached on a pusher cross member 460. Fixedly attached to the upper end of the infeed central post 456 is a back support plate 458. A pair of output posts 462 are fixedly attached to a short beam 464 that is rigidly affixed to the lower structure of the turn box assembly 112. A pair of spaced parallel horizontal slide rods 466 are fixedly mounted between the pair of output posts 462 and the back support plate 458. The pair of horizontal slide rods 466 provide mechanical support and longitudinal freedom to a pusher slide block 468. The pusher slide block 468 is shown in FIG. 2 in its full back position. The longitudinal movement of the pusher slide block 468 is controlled by a pusher cylinder 470 that is fixedly attached to a pusher cylinder mount 472. The pusher cylinder mount 472 is fixedly attached through a slot in the top of the back support plate 458 and onto the top of the infeed central post 456. A cylinder rod 474 of the pusher cylinder 470 is fixedly attached to the infeed side of the pusher slide block 468. A pair of pusher lower arms 476 (FIGS. 2 and 3) are fixedly attached to the pusher slide blocks 468 by means of an outfeed plate 478 (FIG. 2) and a bottom plate 480 that are fixedly attached in assembly to the pair of pusher lower arms 476. A pair of offset blocks 482 (FIGS. 3 and 4) are fixedly attached at the top ends of the pair of pusher lower arms 476 and provide longituinal displacement and mechanical support for a pair of vertical pusher upper arms 484. The vertical pusher upper arms 484 are laterally set inboard of and between the pair of main elevator arms 326 as can be seen in FIG. 4. The pair of vertical pusher upper arms 484 contact the infeed side of the stack of cartons on the main elevator arms 326 when the stack has been compressed by the compressor flaps 96 (FIG. 3) and pushes the compressed stack toward the output end of the bundle accumulator machine 10 as the cylinder rod 474 (FIG. 2) extends from the pusher cylinder 470. The stack of cartons 16 are thereby removed from the compressor assembly 98 and delivered to the basket assembly 102 in their compressed condition. As the cylinder rod 474 (FIG. 2) moves the vertical stack pusher assembly 100 toward the output end of the bundle accumulator machine 10, the longitudinal travel of the vertical stack pusher assembly 100 is stopped upon actuation of a limit switch LS-5 that is fixedly mounted to the right hand side of the turn box assembly 112. This is the fully extended position of the vertical stack pusher assembly 100. In this position the vertical stack pusher assembly 100 is in interference with the basket assembly 102. The basket assembly 102 is prevented from turning until a limit switch LS-28 is tripped as the vertical stack pusher assembly 100 returns to its full back position. A limit switch LS-5B halts the movement of the vertical stack pusher assembly 100 toward the basket assembly 102 when the basket assembly 102 is in its turn position. The turn position of the basket assembly 102 does not provide an interference fit between the two assemblies as will be more fully described hereinafter. A limit switch LS-3 indicates that the vertical stack pusher assembly 100 is at its start position at the infeed end of the pair of horizontal slide rods 466. The limit switch LS-3 also serves to reset the appropriate circuits to be described hereinafter in greater detail that permit the auxiliary elevator assembly 90 to continue with its following cycle as has been previously described. A trip 486 attached to the left side of the pusher slide block 468 provides mechanical contact for limit switches LS-5B, LS-28 and LS-3. The limit switch LS-5 is tripped by the upper portion of the outfeed plate 478 when the stack pusher assembly 100 is fully extended.

TIP-OVER ASSEMBLY

The turn box assembly 112, the basket assembly 102 and the tip-over assembly 104 serve a transport and reorientation function in processing the stack of cartons from the stacking assembly 52 to the pushoff assembly 106.

The basket assembly 102 is a receiving device for the stack of cartons as they are delivered from the stacking assembly 52. The basket assembly 102 is also equipped with various devices to maintain the quality of the stack during transport. The basket assembly 102 receives smaller cartons in a no turn or normal straight in manner. Larger cartons, whose individual carton length is too large for insertion into the cassette receiver 18, are inserted into the basket assembly 102 from the side or in a turn position, as will be explained in greater detail hereinafter. This is provided by virtue of the turn box assembly 112 that can rotate the basket assembly 102 90° in the counterclockwise direction when viewing the bundle accumulator machine 10 from above.

Figure 11:
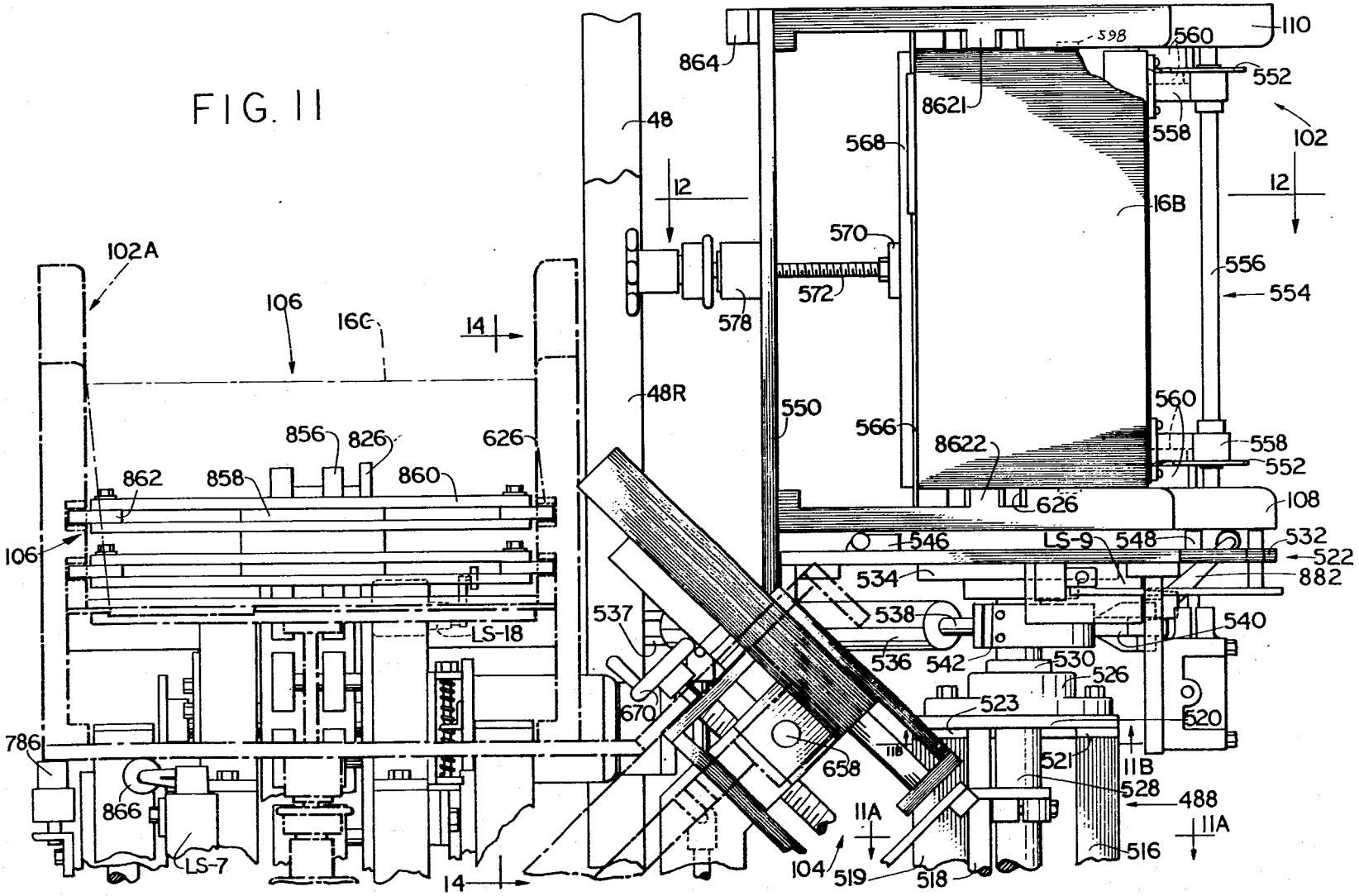
FIG. 11 is a view in side elevation of a basket assembly section of the machine on an enlarged scale, the basket assembly being shown in lowered position in dot-dash lines.
Figures 11A, 11B:
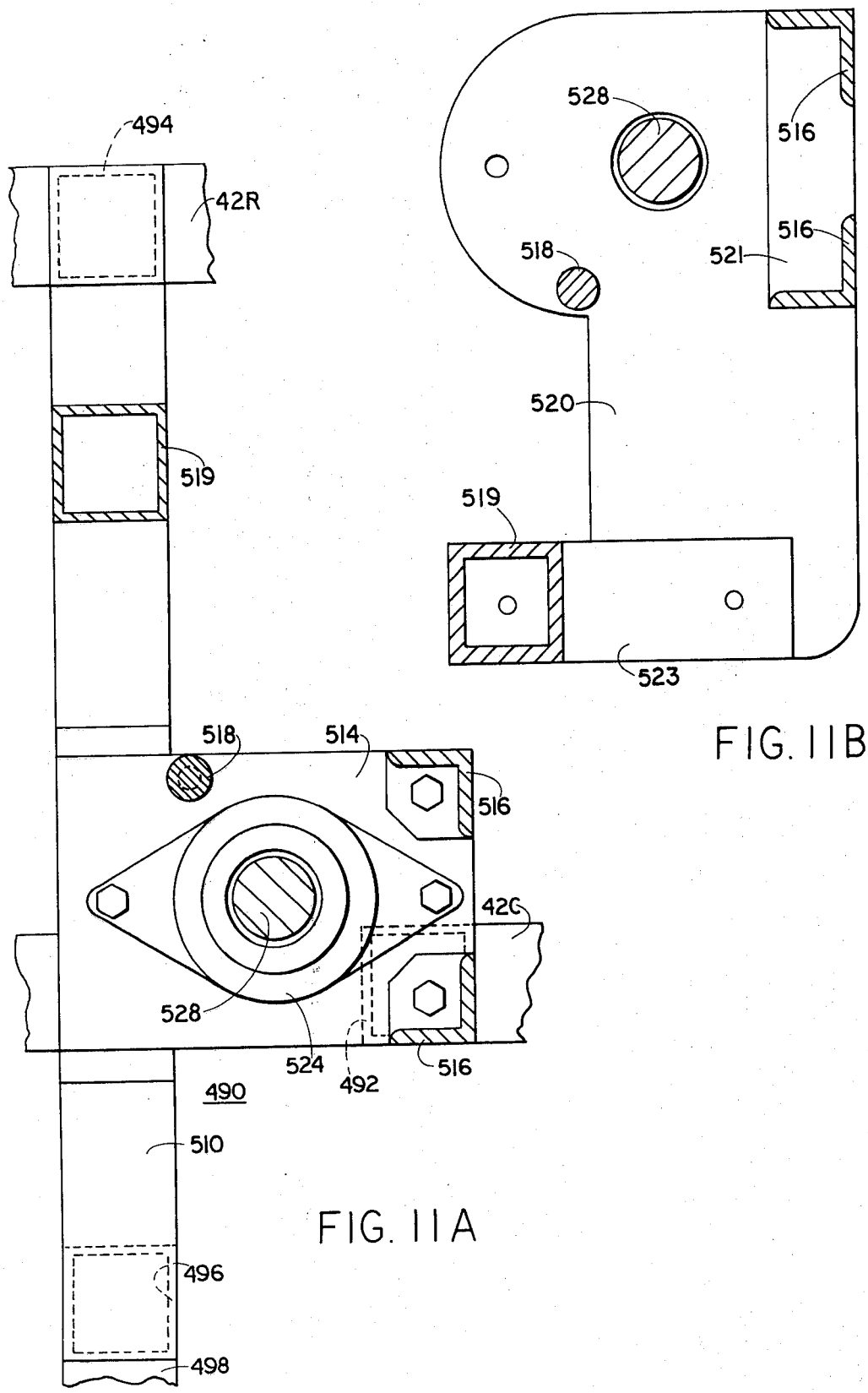
FIG. 11A is a view in section taken on the line 11A—11A in FIG. 11.
FIG. 11B is a view in section taken on the line 11B—11B in FIG. 11.

Referring to FIG. 2, the turn box assembly 112 is comprised of a turn box 488 and a support structure 490. The support structure 490 comprises several vertical support members that include a turn box mid post 492 located at the infeed side of the assembly and mounted on the mid position bottom elevator stringer 42C. It also includes a right side post 494 fixedly attached to the bottom elevator stringer 42R. A left side post 496 (FIGS. 2 and 11A) is vertically fixed to a turn box cross member 498 which spans the stringers 42 and 42R. A horizontal frame 510 is fixedly attached across the top of the right side post 494 and left side post 496 and holds them in lateral spaced relationship as well as functioning as a supporting structure. A frame 512 (FIG. 2) is fixedly attached between the right side output elevator post 48R and the right side post 494 and provides longitudinal stability to the support structure 490. A turn box bottom mount plate 514 is supported on top of the horizontal frame 510 and the turn box mid post 492 and provides mounting support for the turn box 488. The turn box 488 comprises several vertical supports that include a pair of infeed posts 516 fixedly attached at the corners of the rectangular turn box bottom mount plate 514 and a third bar post member 518. An upright frame 519 (FIGS. 11A and 11B) is fixedly attached at the center of the laterally disposed horizontal frame 510. A top mount plate 520 (FIGS. 2, 11 and 11B) is fixedly attached to a plate 521 (FIGS. 11 and 11B) which spans the top of the pair of infeed posts 516 and to a plate 523, which is attached to the output member 518, providing mounting structure for a turntable assembly 522 (FIG. 11). Referring again to FIG. 2, a bottom bearing 524 is fixedly mounted to the top of the turn box bottom mount plate 514. A top bearing 526 is likewise fixedly mounted on top of the top mount plate 520. Rotatably held in the bottom bearing 524 and the top bearing 526 is a turntable post 528. Referring now to FIG. 11, the turntable post 528 is held in vertical position by a collar 530. Fixedly attached to the top of the turntable post 528 by means of a mount plate 534 is a turntable plate 532. The turntable plate 532 has a rotatable degree of freedom by virtue of the turn post 528, the turn post 528 being controlled and actuated by means of a turn cylinder 536 whose base is rotatably joined to the right side output elevator post 48R by means of a mount bracket 537 mounted on the post 48R. A turn cylinder rod 538 is pivotally connected to a turn cylinder arm 542 that is fixedly attached to the turn post 528. Operation of the turn cylinder 536 in sequential relationship with other assemblies of the bundle accumulator machine 10 will be hereinafter described.

Figure 12:
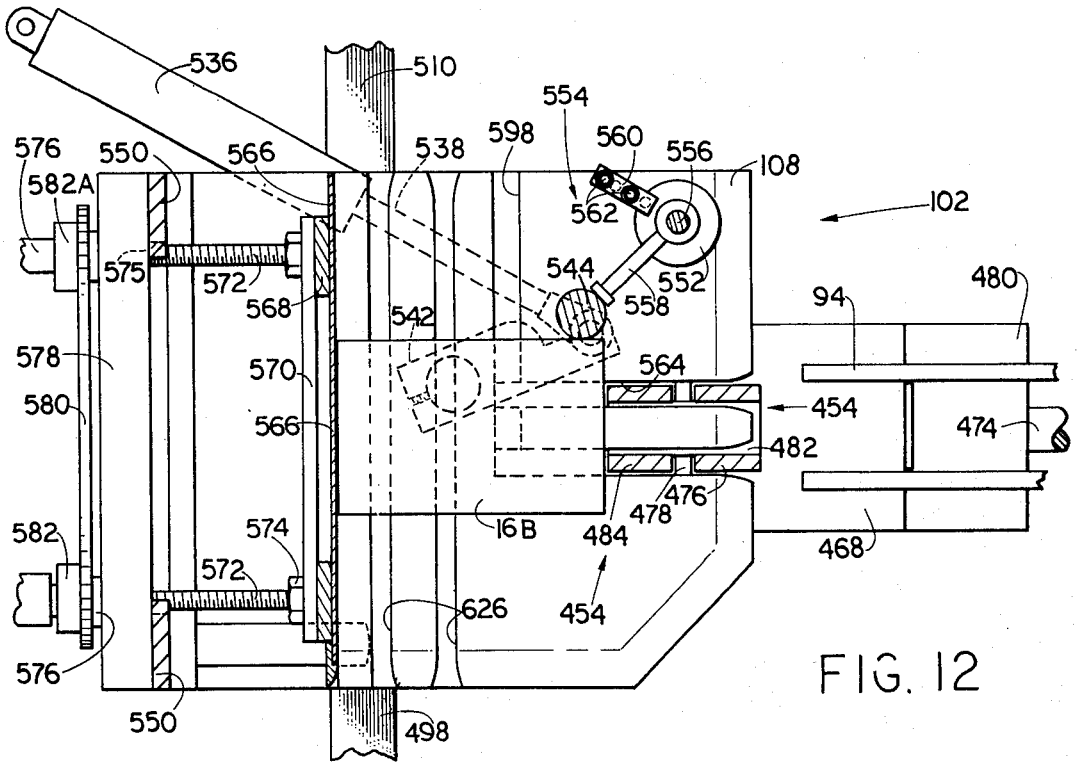
FIG. 12 is a view in section taken on the line 12—12 in FIG. 11.

Referring to FIGS. 11 and 12, the basket assembly 102 is comprised of the basket bottom 108 that can rest on a pair of basket roller supports 546 and a pair of basket stops 548 that are fixedly attached to the turntable plate 532. The plan view of the turntable plate 532 is substantially identical to the plan view of the basket bottom 108 as shown in FIG. 12, and therefore is not visible in that view. Referring to FIGS. 11 and 12, a pair of vertical back mount arms 550 are fixedly attached to the output side of the basket bottom 108. The pair of vertical back mount arms extend below the basket bottom 108 to provide mounting support for the tip-over assembly 104 (FIGS. 2 and 11). The basket top 110 (FIG. 11) is fixedly attached to the upper ends of the pair of vertical back mount arms 550 in the same plan view position as the basket bottom 108 shown in FIG. 12. The input edges of the basket bottom 108 and the basket top 110 are rounded to facilitate the reception of the stack of cartons 16B as shown in FIG. 11. The basket top 110 maintains a compressive force on the stack of cartons 16B after it has been removed from the compressor assembly 98 (FIG. 2) by means of the vertical pusher assembly 454. As the stack of cartons 16B move into the basket assembly 102 (FIG. 11), they are held in lateral alignment by a no turn stack keep assembly 554 (FIG. 12). The no turn stack keep assembly 554 is comprised of a pivot rod 556 pivotally inserted into bearing holes (not shown) in the basket bottom 108 and the basket top 110. A pair of locking flanges 552 are fixedly attached near the top and bottom of the pivot rod 556. Adjacent to the pair of locking flanges 552 and also fixedly attached to the pivot rod 556 is a pair of side keep mount arms 558. A side keep bar 544 is fixedly and vertically attached at the ends of the pair of side keep mount arms 558. The side keep bar 544 swings through an arc about the pivot rod 556 and in this manner is adjustable at different lateral positions to accommodate different size stacks of cartons. It is locked in place by means of a pair of locking clamps 560 that are securely clamped against the pair of locking flanges 552 by a set of bolts 562.

As the vertical pusher assembly 454 continues to advance the stack of cartons 16B (FIG. 11) into the basket assembly 102, the pair of vertical pusher upper arms 484 (FIG. 12) move into two pairs of slots 564, each pair corresponding to the basket bottom 108 and the turntable plate 532. In this manner the vertical pusher assembly 454 is in direct interference with the basket assembly 102; the basket assembly 102 is restricted from rotation by the action of a circuit controlled by the limit switch LS-28 as previously described. The vertical stack pusher assembly 100 continues into further interference with the basket assembly 102 until the limit switch LS-5 (FIG. 2) is activated to cause arrest of the motion of the vertical pusher assembly 454, as has been previously described. At this position the leading side of the stack of cartons 16 is resting coincident with a basket tray 566 (FIG. 11). The basket tray 566 is fixedly mounted to a pair of tray mount arms 568. A tray cross bar 570 is fixedly and laterally attached across the output faces of the pair of tray mount arms 568. A pair of tray adjusting screws 572 are perpendicularly threaded into the tray cross bar 570 adjacent to the pair of tray mount arms 568 and are locked into place by a pair of lock nuts 574. The pair of tray adjusting screws 572 longitudinally extend through slots 575 (FIG. 12) in the pair of vertical back mount arms 550 and into a pair of screw adjusting assemblies 576. These assemblies are in turn mounted through a tray adjusting mount 578 attached to the tray mount arms 550. The pair of screw adjusting assemblies 576 are similar in structure and function to the set of six lateral adjusting assemblies 202 as previously described with respect to FIG. 4 and turning of sprocket wheels 582 and 582A (FIG. 12) causes advance of the basket tray 566, as shown in FIG. 12, toward and away from the mount 578. The pair of screw adjusting assemblies 576 are coupled together by a chain 580 which runs on the pair of sprocket wheels 582 and 582A. A handle 5811 (FIG. 13) is attached to the sprocket wheel 582 for turning the sprocket wheels 582 and 582A.

Figure 17:
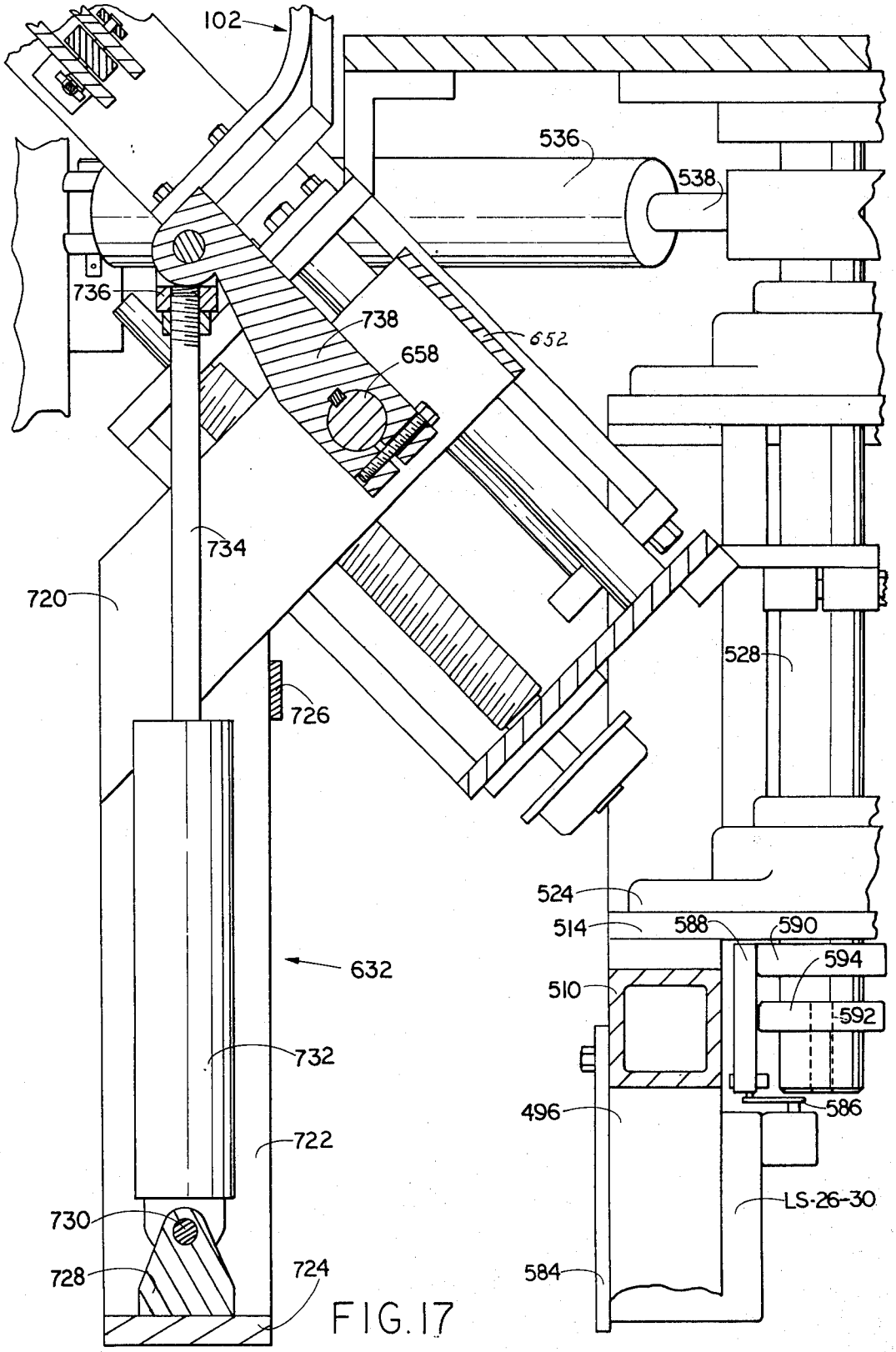
FIG. 17 is a view in section taken on the line 17—17 in FIG. 14.

In cases where the individual carton length is of sufficient magnitude that the stack of cartons 16 will not clear the top of the cassette receiver 18 (FIG. 1), then the output stack is turned over on its side so that the width of the individual carton will become the output stack height and thereby permit entry into the casette receiver 18. This process of carton stack re-orientation begins by rotating the turntable assembly 522 (FIG. 11) 90° counterclockwise when viewing the bundle accumulator machine 10 from above as in FIGS. 12 and 13 to the FIG. 13 position. In FIG. 12, the turn cylinder rod 538 is in its extended position. When the turn cylinder rod 538 is in extended position, a limit switch assembly LS-26-30 including turn limit switches LS-26 and LS-30 (FIG. 17) is actuated in one direction. The limit switch assembly LS-26-30 is mounted on a plate 584 that is fixedly mounted to the horizontal frame 510 of the turn box support structure 490, as can be seen in FIG. 17. A switch arm and roller 586 actuates the limit switch assembly LS-26-30. The limit switch assembly LS-26-30 has two sets of controls. In the no turn position, at which the cylinder rod 538 is extended, as has been previously described, a trip 588 fixedly attached to an upper trip collar 590 that is fixedly attached to the turntable post 528 near its lower extremity, contacts the switch arm and roller 586 and throws it toward the right side of the bundle accumulator machine 10. At the no turn position, controls L-26 (FIG. 21) of the limit switch assembly LS-26-30 are actuated. When the turn cylinder rod 538 is retracted and the basket assembly 102 has been rotated counterclockwise to the FIG. 13 or turned position, a trip 592 (FIG. 17) of a lower collar 594 contacts the switch arm and roller 586 moving it toward the left side of the bundle accumulator machine 10. At this turned position, contacts LS-30A (FIG. 21) and LS-30B (FIG. 22) of the limit switch assembly LS-26-30 are actuated.

Figure 13:
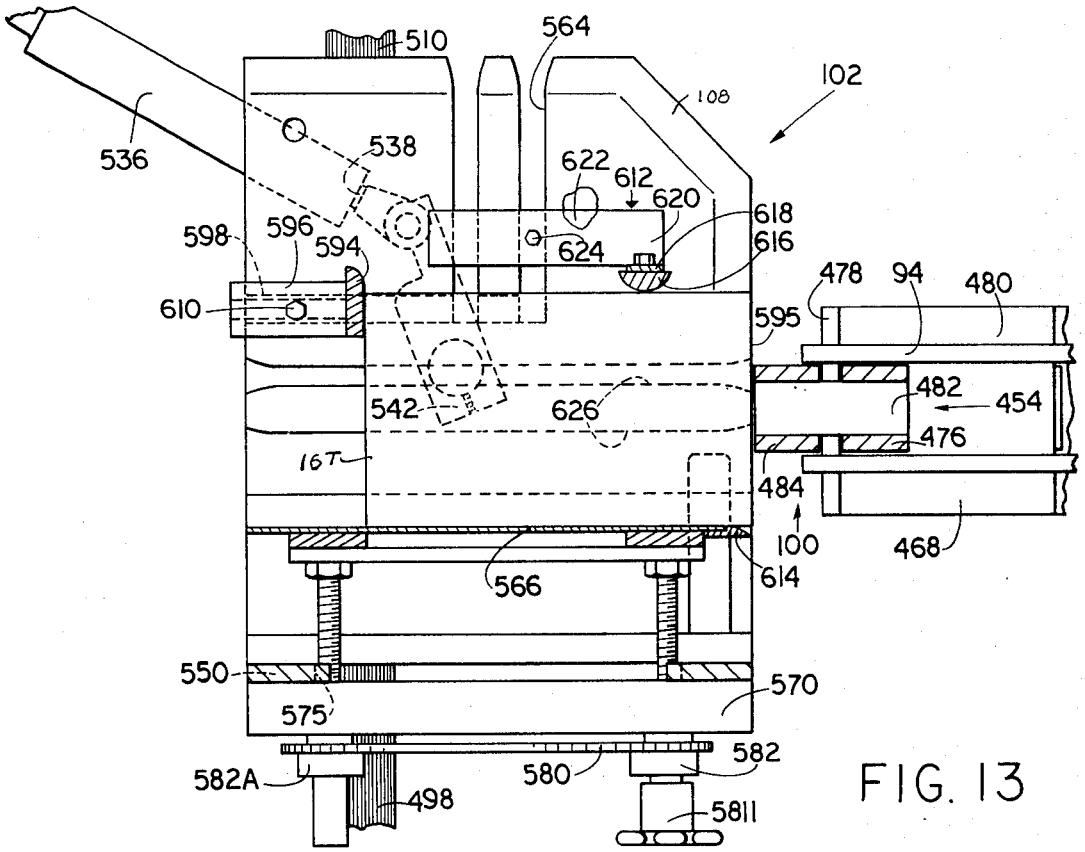
FIG. 13 is a view taken on the same line as FIG. 12 showing the basket assembly in turned position, a no turn stack keep assembly being omitted and a turn stack keep assembly being in position.

Referring to FIG. 13, the vertical pusher assembly 454 moves toward the output end of the bundle accumulator machine 10 and stops upon contact with the limit switch LS-5B (FIG. 2) when the circuitry is set for the turn mode. The output edges of the pair of vertical pusher upper arms 484 are now adjacent to a side input edge 595 (FIG. 13) of the basket bottom 108. The output side of a stack of cartons 16T is now coincident with a turn backstop 594. The turn backstop 594 is rigidly fixed to a pair of backstop locks 596, one of which is shown in FIG. 13. The backstop locks 596 slide into a pair of grooves 598 in the basket top 110 and the basket bottom 108. The pair of grooves 598 extend slightly more than half way across these plates, providing full latitude for adjustment to varying carton sizes. The backstop locks 596 are held in place by a pair of bolts 610 that threadably extend through the pair of backstop locks 596 and butt against the basket top 110 and basket bottom 108 to wedge the assembly in place. The turn backstop 594 maintains the stack of cartons in longitudinal and vertical alignment as the stack of cartons 16 comes to rest in the basket assembly 102. Lateral and vertical alignment of the stack of cartons is provided by the basket tray 566 on the left side, and a turn stack keep assembly 612 on the right side. To facilitate the entry of the stack of cartons into the basket assembly 102, a tray nose piece 514 is fixedly attached to the input edge of the basket tray 566 as seen in FIG. 13. The turn stack keep assembly 612 is comprised of a guide bar 616, fixedly attached to a guide bracket 618 that is rigidly affixed to a pair of end clamps 620 (only one of which is shown). The pair of end clamps 620 fit on the inside surfaces of the basket assembly 102, while a corresponding pair of backup clamps 622 fit on the outside surfaces of the basket assembly 102. A pair of bolt and nut combinations 624 fixedly fasten each pair of end clamps 620 to their corresponding pair of backup clamps 622. The pair of bolt and nut combinations 624 pass through selected ones of the two pairs of slots 564.

Referring to FIGS. 12 and 13, the basket bottom 108 is provided with a pair of channels 626 each to function as guideways for the pushoff assembly 106 (FIG. 2). The basket top is provided with similar channels, not shown. In FIG. 12 the pair of channels 626 are laterally disposed; in FIG. 13 they are longitudinally disposed.

The tip-over assembly 104 (FIG. 2) is constructed to fulfill two conditions. First, the basket bottom 108 rotates from a fixed horizontal plane to a fixed vertical and lateral plane. Second, the basket tray 566 (FIG. 11) in the no turn mode rotates from a variable vertical and lateral plane to a fixed horizontal plane. Each setting of the basket tray 566, which is necessary to accommodate different sizes of cartons, requires a particular radius of rotation.

The various adjustments of the axis of rotation of the tip-over assembly 104 require movement of the axis at an angle of 45° from the horizontal plane. This is the path along which the tip-over axis, the axis of a tip shaft 658 (FIGS. 2, 11, and 15-17 inclusive), is moved. The machinery necessary to accomplish these functions will now be described.

The tip-over assembly 104 (FIG. 2) comprises three structural subassemblies; a tip-over mounting structure 628 (FIG. 14), a basket mounting structure 630, and an actuation structure 632.

Figure 14:
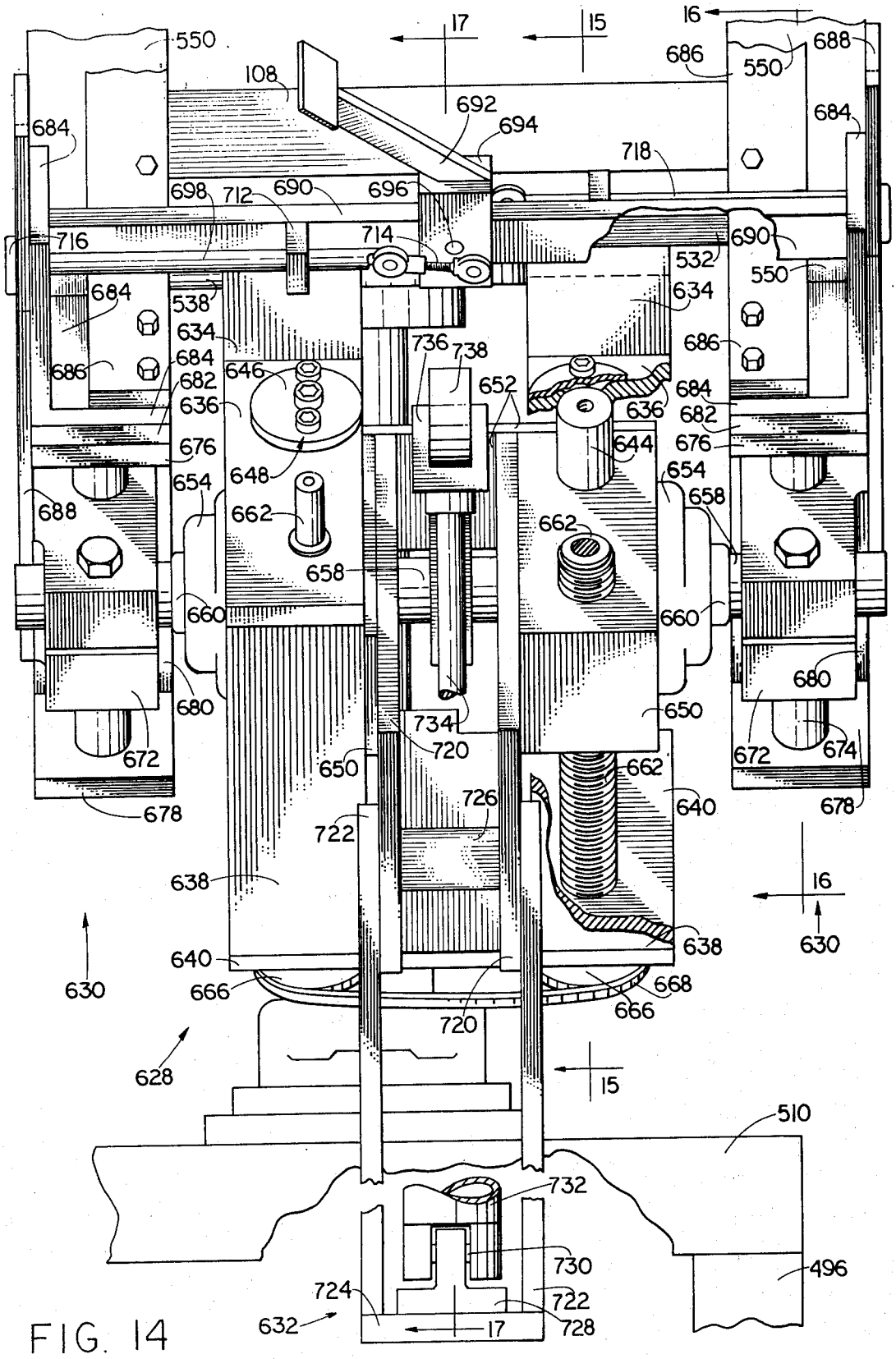
FIG. 14 is a fragmentary view in end elevation looking in the direction of the arrow 14—14 in FIG. 11, parts being broken away and in section.
Figure 15:
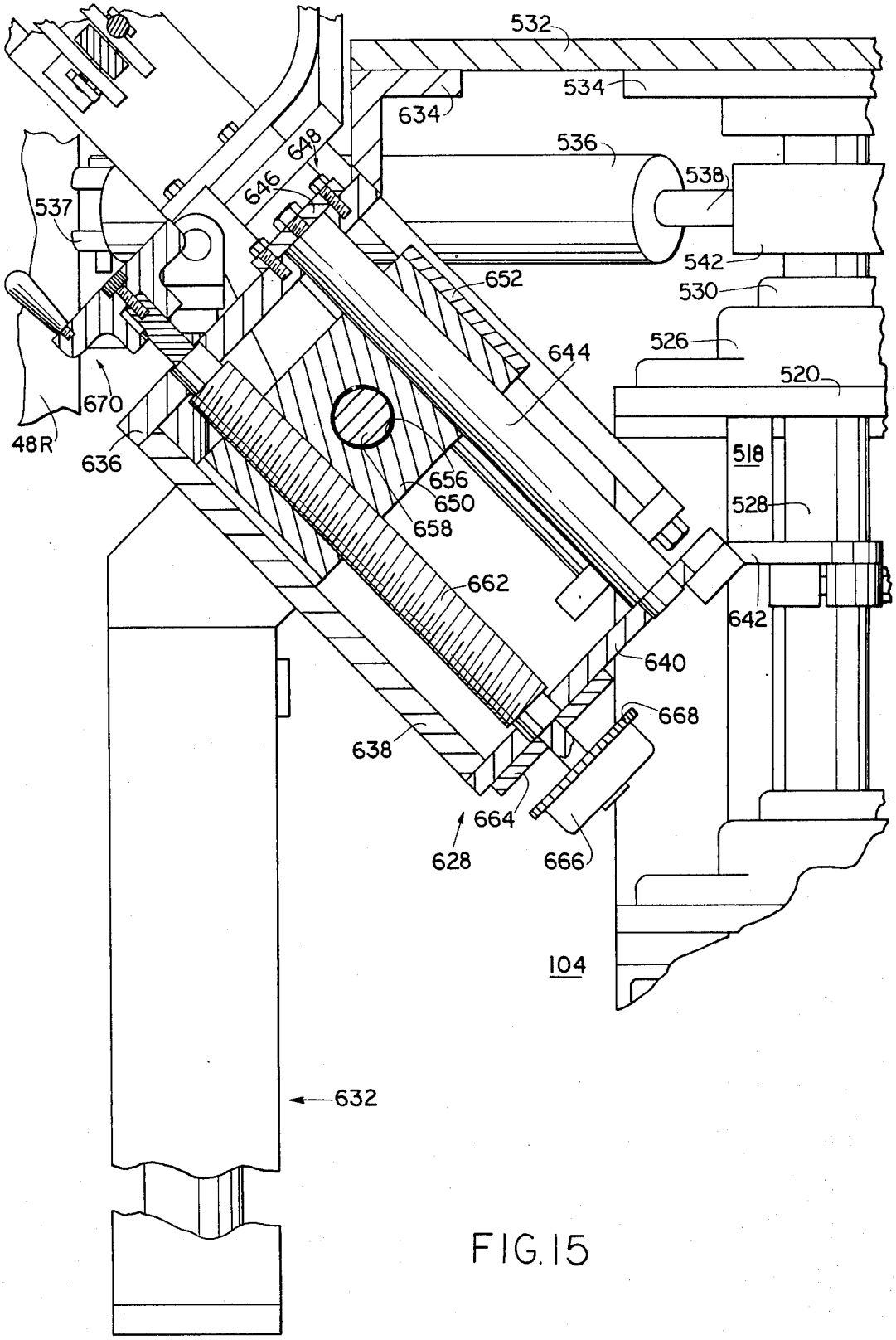
FIG. 15 is a view in section taken on the line 15—15 in FIG. 14.

The tip-over mounting structure 628 is shown in detail in FIGS. 14, 15, 16 and 17. The tip-over mounting structure 628 (FIGS. 14 and 15) incorporates a pair of angle brackets 634 fixedly attached to the underside output edge of the turntable plate 532. Fixedly attached to the bottom edge of the pair of angle brackets 634 at an angle of 45° is a pair of tip-over bracket top plates 636. A pair of tip bracket bottom plates 638 are fixedly attached at right angles to the bottom of the pair of tip-over bracket top plates 636. A tip bracket back plate 640 is fixedly attached to the bottom edges of the pair of tip bracket bottom plates 638 in such a manner that a rectangular supporting structure is formed. Fixedly attached to the top right side edge of the tip bracket back plate 640 is a tip bracket brace 642 (FIG. 15) that in turn is fixedly clamped to the turntable post 528. Thus, the major supporting structure of the tip-over assembly 104 is fixedly attached to the turntable plate 532 and the turntable post 528, and rotates therewith. A pair of tip bracket guide rods 644 are fixedly mounted between the upper edges of the pair of tip-over bracket top plates 636 and the tip bracket back plate 640. The guide rods 644 are fixedly attached in place by means of a pair of guide rod snubs 646. Each of the pair of guide rod snubs 646 is held in place by a set of three bolts 648 that prevent rotational and longitudinal movement of the pair of tip bracket guide rods 644. The tip-over mounting structure 628 also incorporates a pair of tip-over slide blocks 650 slidably mounted on the pair of tip bracket guide rods 644 and held in parallel spaced relationship to each other by a tip-over slide block tie bar 652. A pair of tip bearings 654 are fixedly mounted to the outboard faces (FIG. 14) of the pair of the tip-over slide blocks 650 and cooperate with a pair of clear through holes 656 located at the center of the pair of tip-over slide blocks 650 (FIG. 15). In turn, the pair of tip bearings 654 rotatably hold the tip shaft 658. The tip shaft 658 is held in lateral place by a pair of shaft collars 660 (FIG. 14) fixedly attached to the tip shaft 658. The pair of tip-over slide blocks 650 move along the pair of tip bracket guide rods 644 under thee control of a pair of tip bracket screws 662. The pair of tip bracket screws 662 are threadably mounted through the pair of tip-over slide blocks 650, as shown in FIG. 15, and are rotatably bearinged at each end in the pair of tip-over bracket top plates 636 and the tip bracket back plate 640. A pair of bottom snub plates 664 are fixedly attached to the outside surface of the tip bracket back plate 640 and retain the pair of tip bracket screws 662 in place. The top extremity of the left hand member of the pair of tip bracket screws 662 is fitted with a crank and handle 670 (FIG. 15). The bottom extremity of each of the pair of tip bracket screws 662 is rigidly fitted with a sprocket wheel 666. A chain 668 connects the two sprocket wheels 666 together as shown in FIG. 14 so that when one is turned, the other will also rotate an equal amount. Therefore, by rotating the crank and handle 670, the tip shaft 658 is moved along a plane therethrough which is at an angle of 45° to the horizontal (see FIG. 15) as necessary to rotate the basket assembly 102 (FIG. 11) from its input position to its output position for different sizes of cartons.

Figure 16:
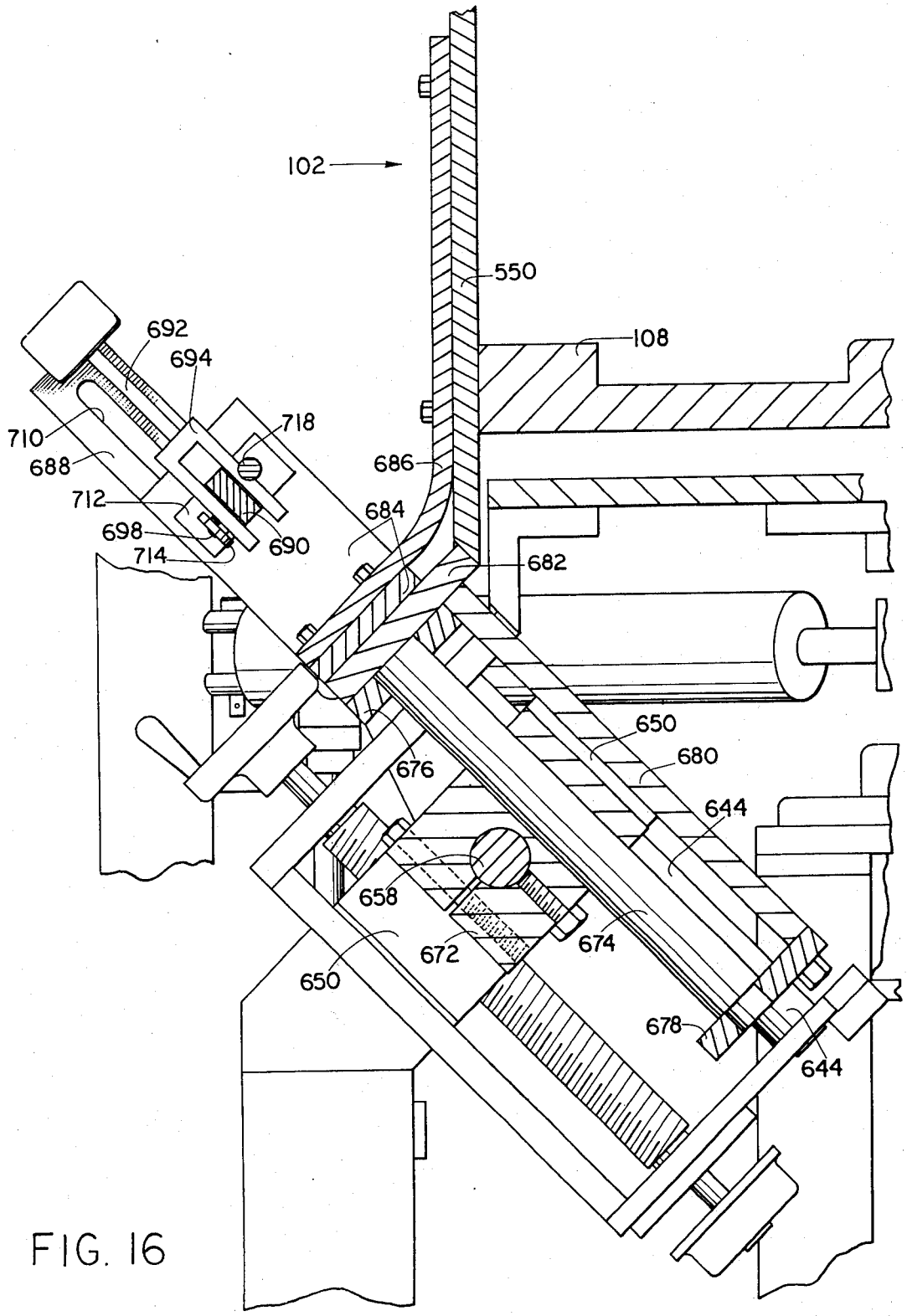
FIG. 16 is a view in section taken on the line 16—16 in FIG. 14.

The basket mounting structure 630 is shown in detail in FIGS. 14 and 16. Fixedly attached to the outboard ends of the tip shaft 658 is a pair of basket slide blocks 672 (FIG. 14). The basket mounting structure 630 provides a pair of basket slide rods 674 that are slideably held in the pair of basket slide blocks 672. Frictionally fitted to the upper extremity of the pair of basket slide rods 674 is a pair of basket top plates 676. In like manner, a pair of basket bottom plates 678 are frictionally fitted to the bottom extremity of the pair of basket slide rods 674. The pair of basket top plates 676 and the pair of basket bottom plates 678 are held in fixed alignment with each other by means of a pair of slide yokes 680. A pair of basket mounts 682 are fixedly attached to the top surfaces of the pair of basket top plates 676. The pair of basket mounts 682 are fixedly attached to the bottom ends of the pair of vertical back mount arms 550. This structural arrangement slideably mounts the basket assembly 102 to the pair of basket slide blocks 672 so that the position of the tip shaft 658 can be changed along the pair of tip bracket guide rods 644 and the pair of basket slide rods 674 without changing the position of the basket bottom 108. A pair of basket lock mounts 684 of angular form are fixedly attached to the upper faces of the pair of basket mounts 682. A pair of basket back braces 686 are boltedly affixed over the pair of basket lock mounts 682 and to the pair of vertical back mount arms 550 to add structural strength to the tip-over assembly 104 and basket assembly 102 interface. A pair of tip-over lock shoes 688 are fixedly attached to the pair of basket slide blocks 672 and extend upwardly and parallel to the pair of basket lock mounts 684. The pair of basket lock mounts 684 are secured in parallel and longitudinal rigidity by a tip lock mount 690 fixedly mounted therebetween. A basket lock handle 692 is fixedly attached to a lock pivot yoke 694 that is pivotally attached to the center of the tip lock mount 690 by means of a lock pin 696. A right side tension bar 698 is slideably mounted through a slot in the right side member of the pair of tip-over lock shoes 688, through a clear hole in the right side member of the pair of basket lock mounts 684 and through a rod holder 712 that is fixedly attached to the tip lock mount 690 and by means of a turnbuckle connector 714 connects to the lock pivot yoke 694 slightly below the lock pin 696. The right hand extremity of the right side tension bar (left side of FIG. 14) incorporates a relatively large diameter head 716 that lies flat against the outside surface of the right hand member of the pair of tip-over lock shoes 688. A left side tension bar 718 is installed in identical manner except that its turnbuckle is connected on the opposite side of the lock pivot yoke 694 and above the lock pin 696. As the basket lock handle 692 is rotated toward the right hand side of the machine (to the left in FIG. 14), tension is applied to the tension bars 698 and 718 thereby compressing the pair of tip-over lock shoes 688 against the pair of basket lock mounts 684, frictionally coupling the basket assembly 102 to the pair of basket slide blocks 672. These assemblies are locked in place since the lock pivot yoke 694 and the tension bar turnbuckles form an off-center latch.

The actuation structure 632 is shown in FIGS. 14 and 17, and incorporates a pair of upper stirrup beams 720 that are fixedly mounted to the inboard surfaces of the pair of tip-over slide blocks 650 (see FIG. 14). Vertically attached to the ends of the pair of upper stirrup beams 720 is a pair of stirrup members 722. A cylinder mount block 724 is fixedly attached across the bottom of the pair of stirrup members 722. A stirrup stiffener 726 is fixedly mounted across the upper portion of the pair of stirrup members 722 to provide fixed lateral spaced relationship thereto. A tip cylinder lug 728 is fixedly mounted on top of the cylinder mount block 724 and receives a cylinder pin 730 of a tip cylinder 732. A tip cylinder rod 734 extends upwardly and is threadably mounted in a rod lug 736. The rod lug 736 is pinned to a tip shaft arm 738 that is in turn fixedly keyed to the tip shaft 658. As the tip cylinder 732 retracts the tip cylinder rod 734, the tip shaft 658 is rotated within the pair of tip bearings 654 (FIG. 14), and by virtue of the fact that the pair of basket slide blocks 672 are fixedly attached to the tip shaft 658, the basket assembly 102 is rotated from its input position to its output position (102A in FIG. 11) in front of the pushoff assembly 106.

When the stack has been advanced into the basket assembly 102 at the FIG. 13 (turned) position, the vertical stack pusher assembly 100 is withdrawn until clear of the basket assembly 102 as indicated by the limit switch LS-28 (FIG. 2) and the turn cylinder rod 538 (FIG. 17) is extended from the turn cylinder 536 and thereby rotates the basket assembly 102 clockwise until the trip 588 contacts the limit switch assembly LS-26-30, thereby making the appropriate circuit that begins the tip-over of the basket assembly 102. Referring to FIG. 11, the basket assembly 102 rotates from its infeed position shown in solid lines to its output position shown in dot-dash lines at 102A under the motive power and control of the tip cylinder 732 (FIG. 17). The basket assembly 102 (FIG. 11) is now lying on its back in front of the pushoff assembly 106. This constitutes the advance portion of the basket and tip-over turn cycle, the reset portion of this cycle will be described hereinafter.

PUSHOFF ASSEMBLY

Figure 18:
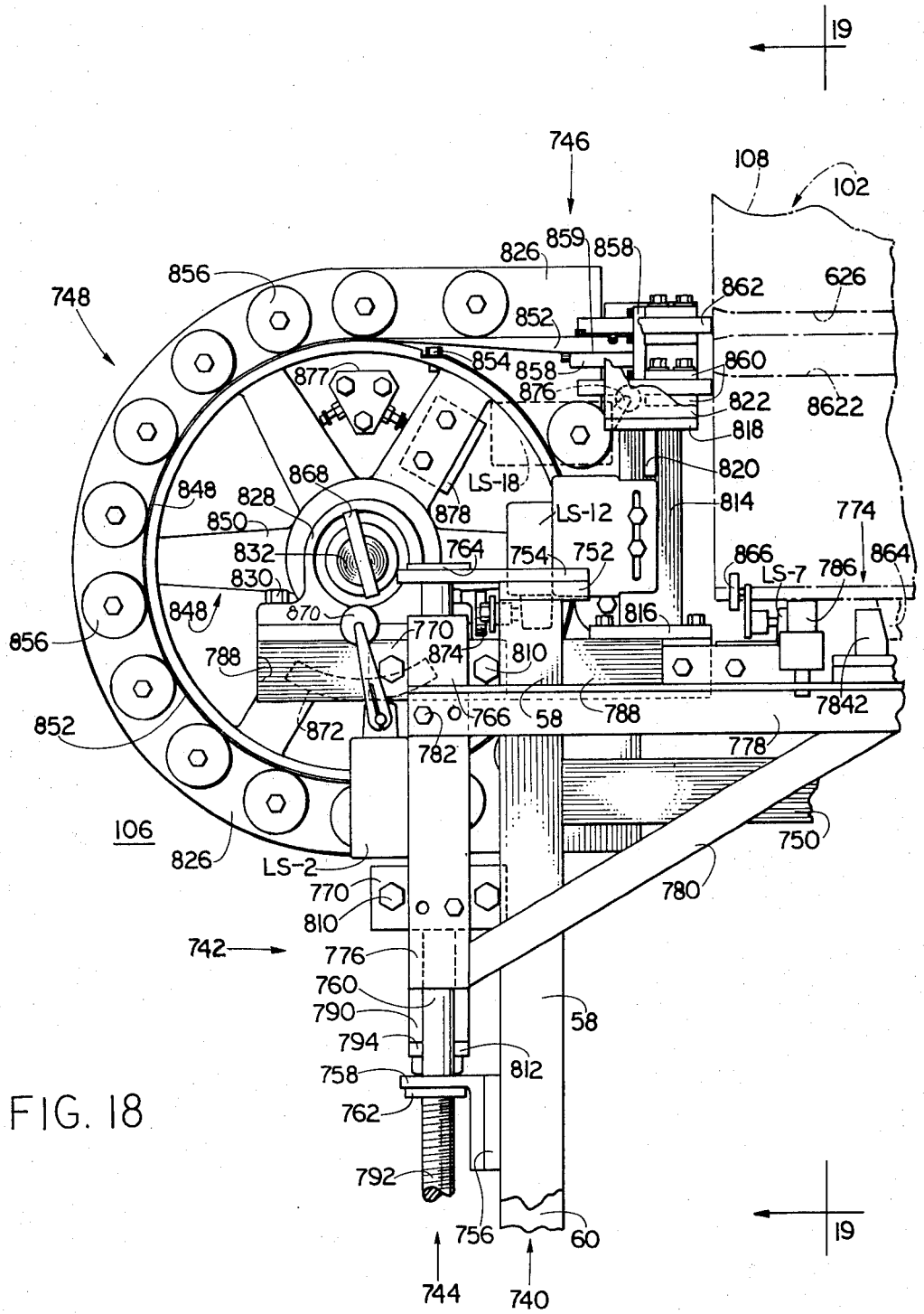
FIG. 18 is a view in end elevation on an enlarged scale looking in the direction of the arrows 18—18 in FIG. 2, a part of the basket assembly of the machine being shown in lay-over position in dot-dash lines.
Figure 19:
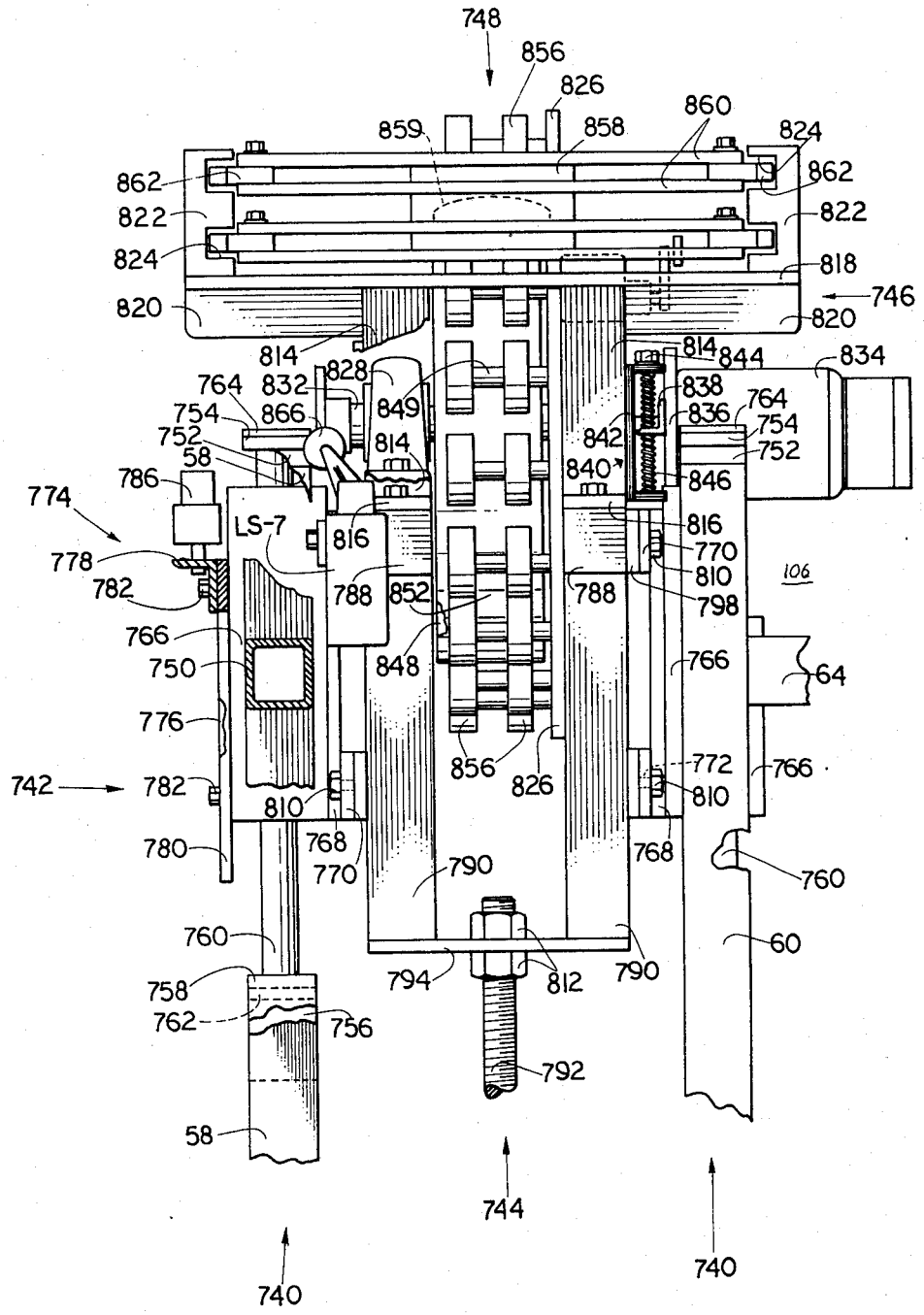
FIG. 19 is a view in section taken on the line 19—19 in FIG. 18.
Figure 20:
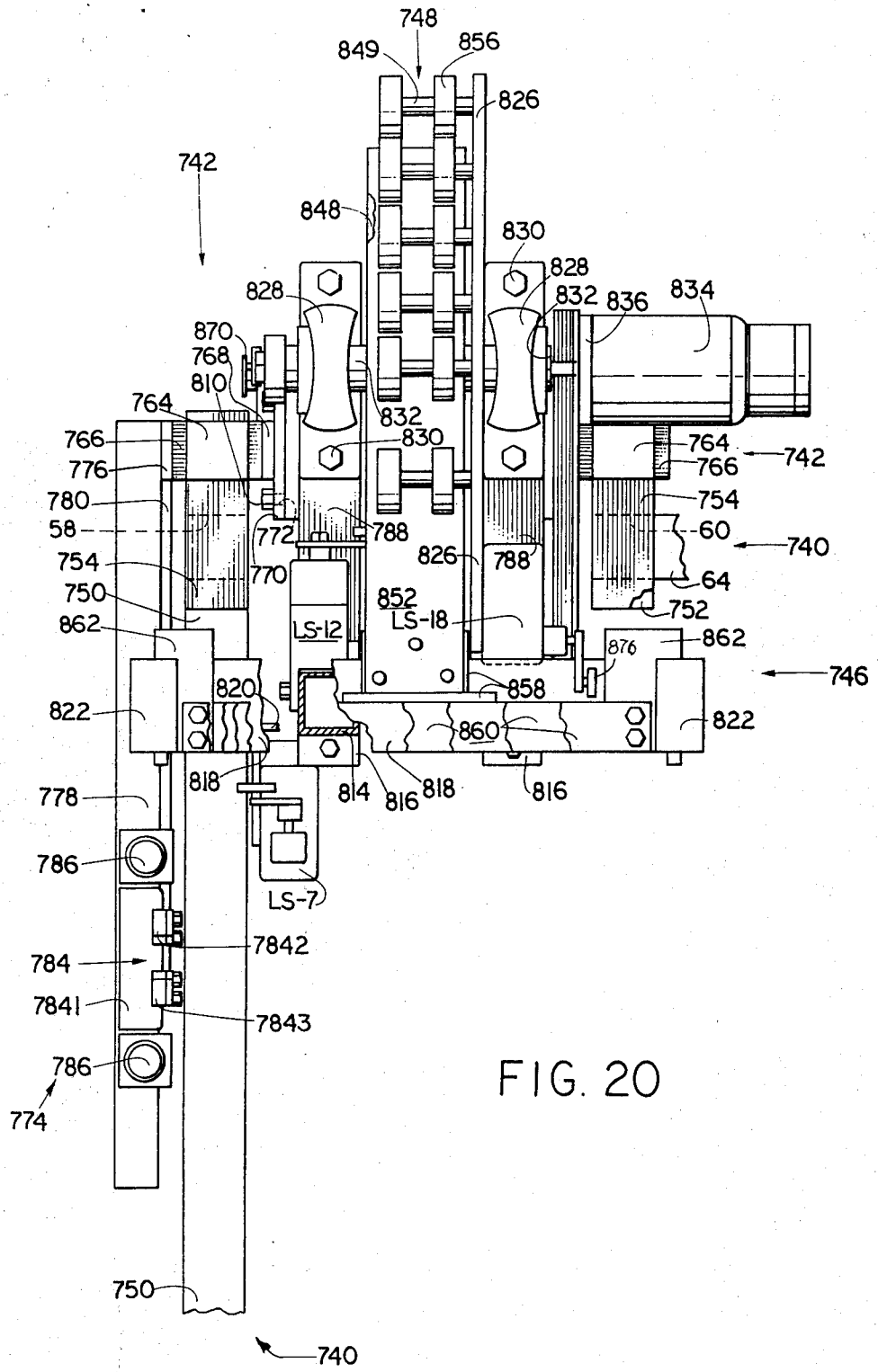
FIG. 20 is a top plan view of the portion of the machine shown in FIGS. 18 and 19.

The pushoff assembly 106 comprises a fixed structure subassembly 740 (FIGS. 18 and 19), a slide structure assembly 742, an adjustable mounting yoke 744, a pusher mounting structure 746, and a pusher assembly 748, as shown in FIGS. 18, 19, and 20.

The fixed structure subassembly 740 incorporates the end slide post 58 and the input slide post 60 of the pushoff frame assembly 30. An end top cross member 750 is fixedly, laterally and horizontally attached between the end slide post 58 and the end corner post 56, as shown in FIGS. 2 and 18. The end top cross member 750 provides lateral stability to the end slide post 58. The short stringer 64 (FIG. 2) provides longitudinal stability to the input slide post 60. The top of each of the end slide post 58 and the input slide post 60 is fitted with a top plate 752 (FIGS. 18 and 19). Fixedly attached to the top of the two top plates 752 is a pair of top slide anchors 754. A spacer 756 is fixedly attached to the right hand face of the end slide post 58 and the input slide post 60 (left side thereof in FIG. 18). Fixedly attached to the two spacers 756 is a pair of bottom slide rod holders 758. The pair of top slide anchors 754 and the pair of bottom slide rod holders 758 incorporates holes into which a pair of pushoff slide rods 760 frictionally fit. The pair of pushoff slide rods 760 are held in their respective holders by a pair of bottom retainer caps 762, fixedly attached to the bottom surface of the pair of bottom slide rod holders 758, and a pair of top retainer caps 764 fixedly attached to the top surfaces of the pair of top slide anchors 754. The fixed structure subassembly 740 provides mounting structure and a vertical degree of freedom to the slide structure assembly 742.

The slide structure assembly 742 incorporates a pair of pushoff slide blocks 766 (FIG. 19) slidably mounted on the pair of pushoff slide rods 760. A pair of vertical mount plates 768 are fixedly attached to the inboard surfaces of the pair of pushoff slide blocks 766. Fixedly and laterally attached adjacent to the top and bottom of the pair of vertical mount plates 768 is a set of four mounting brackets 770. Each mounting bracket of the set of four mounting brackets 770 incorporate a pair of clear through holes 772 (FIG. 19). The slide block adjacent to the output end of the bundle accumulator machine 10 of the pair of pushoff slide blocks 766 incorporates a basket stop assembly 774. The basket stop assembly 774 provides a vertical rail mount 776, a basket support rail 778, and a rail stiffener 780. The basket support rail 778 is fixedly attached at a right angle to the upper end of the vertical rail mount 776. The rail stiffener 780 is diagonally and rigidly affixed between the bottom end of the vertical rail mount 776 and the basket support rail 778. The basket stop assembly 774 is fixedly attached by a pair of bolts 782 to the output face of the output member of the pair of pushoff slide blocks 766 and extends laterally toward the left side of the bundle accumulator machine 10. Fixedly attached on top of the basket support rail 778 is an alignment jig 784 and a pair of basket bumpers 786 (FIG. 20). The alignment jig 784 includes a mounting plate 7841 and guides 7842 and 7843 supported thereon. The basket stop assembly 774 insures that the basket assembly 102 will rest in positive alignment with respect to the push-off assembly 106. The slide structure assembly 742 functions as a mounting structure for the adjustable mounting yoke 744.

The adjustable mount yoke 744 comprises a pair of horizontal mount rails 788 (FIG. 19), a pair of vertical yoke members 790, a yoke harness 794, a pusher jack screw 792, and a jack wheel 796 (FIG. 2).

The pair of vertical yoke members 790 are fixedly mounted in an erect manner to each end of the yoke harness 794 (FIG. 19). The pair of horizontal mount rails 788 are fixedly attached in a lateral direction across the top of the pair of vertical yoke members 790 that function as mounting rails for the pusher mounting structure 746 (FIG. 20), and the pusher assembly 748 (FIG. 19). The pair of assemblies 788, 790 incorporate a set of four mounting plates 798 that are fixedly attached to the outboard surfaces of the vertical yoke members 790 and the rails 788 and cooperate with the set of four mounting brackets 770 to mount the adjustable mounting yoke 744 to the slide structure assembly 742.

A set of eight bolts 810 freely pass through the pair of clear through holes 772 of each of the set of four mounting brackets 770 and threadably fasten into the set of four mounting plates 798 to fixedly attach the aforementioned assemblies. The adjustable mounting yoke 744 is controlled in vertical adjustment by means of the pusher jack screw 792 that is fixedly held in the yoke harness 794 by means of a pair of jam nuts 812. The pusher jack screw 792 is moved vertically by means of the jack wheel 796 (FIG. 2) through which it is threadably mounted. The jack wheel 796 is bearinged on a bottom support 813 by bearing means, not shown in detail.

The pusher mounting structure 746 (FIGS. 18 and 19) incorporates a pair of pusher guide mounts 814 fixedly mounted on a pair of pusher mount feet 816 that are boltedly mounted on the left side ends of the pair of horizontal mount rails 788. The output direction with respect to the pushoff assembly 106 is laterally from right to left of the bundle accumulator machine 10 (left to right in FIG. 18). Horizontally and longitudinally affixed across the top of the pair of pusher guide mounts 814 is a pusher guide plate 818. A pair of pusher guide plate supports 820 are fixedly attached to the bottom outboard surfaces of the pusher guide plate 818. A pair of pusher guides 822 are fixedly mounted on the top outboard ends of the pusher guide plate 818 in such a manner that a set of four guide grooves 824 (FIG. 19) are aligned with the output direction of the pushoff assembly 106. A pusher wheel plate 826 is vertically and laterally affixed against the inboard faced of the infeed member of the pair of vertical yoke members 790, the infeed rail of the pair of horizontal mount rails 788, and the infeed member of the pair of pusher guide mounts 814. The pusher mounting structure 746 provides structural support and directional control for the pusher assembly 748.

The pusher assembly 748 incorporates a pair of wheel bearings 828 fixedly attached to the right side ends of the pair of horizontal mount rails 788 (FIG. 18) by means of a set of four bolts 830. A wheel shaft 832 (FIG. 20) is rotatably held in the pair of bearings 828. The wheel shaft 832 passes freely through a hole in the pusher wheel plate 826. The wheel shaft is powered by a hydraulic motor 834 fixedly attached to a motor mount 836 that is free of any other attachment. The motor 834 is therefore suspended on the input end of the wheel shaft 832. The motor 834 is operated in both directions and in operation is started and stopped rapidly. A torque arm 838 (FIG. 19) is fixedly attached to the motor mount 836 and extends horizontally and laterally to the left of the bundle accumulator machine 10. The left end of the torque arm 838 is restrained in a shock mount 840 that incorporates a channel bracket 842, a pin 844, and a pair of springs 846. This arrangement will absorb the starting, stopping and running torques of the motor 834 in the pair of springs 846 and channel bracket 842. The channel bracket 842 is fixedly mounted to the input member of the pair of pusher guide mounts 814. Fixedly attached on the wheel shaft 832 between the pair of wheel bearings 828 is a pusher wheel 848 (FIG. 18) which incorporates a set of six spokes 850. A spring steel pusher tongue 852 is fixedly attached to the pusher wheel 848 by means of a pair of bolts 854. The pusher tongue 842 is wrapped clockwise around the pusher wheel 848 and held in place by a set of thirty-four reel rollers 856 that are rotatably mounted on shafts 849 carried by the pusher wheel plate 826 as shown in FIGS. 19 and 20. A pusher mounting block 858 (FIGS. 18 and 19) is boltedly attached to the free end of the pusher tongue 852. A mounting surface 859 (FIG. 19) of the pusher mounting block 858 is of convex shape, thus producing a curvature transversely across the pusher tongue 852 (FIG. 19) as it unrolls from the pusher wheel 848. This adds compression strength to the relatively thin piece of spring steel of the pusher tongue. A set of four pusher bars 860 are laterally and fixedly attached to the face of the pusher mounting block 858. A set of four guide rails 862 are boltedly mounted at the ends of the top and bottom pairs of pusher bars of the set of four pusher bars 860. The set of four guide rails 862 move laterally (with respect to the bundle accumulator machine 10) into and out of the set of four guide grooves 824.

As the basket assembly 102 is rotated from its infeed position as shown in FIG. 11, to its output position in front of the pushoff assembly 106, a tongue 864 that is fixedly mounted to the back edge of the basket top 110, impinges between the guides 7842 and 7843 (FIG. 20) of the alignment jig 784 of the basket stop assembly 744 and secures the basket assembly 102 in lateral alignment (see FIG. 18). The basket assembly 102 also comes to rest on the pair of basket bumpers 786 that secures the assembly in vertical alignment with the pushoff assembly 106. The basket assembly also comes to rest on a switch arm and roller 866 of a limit switch LS-7, depressing it and making the appropriate circuit that indicates that the basket assembly 102 is not fully horizontal. The limit switch LS-7 also cooperates with a limit switch LS-16 located on the customer bundle overwrap machine (not shown in detail), so that when both of the switches LS-7 and LS-16 are made, the circuitry gives the proper signal to begin the pushoff cycle. The motor 834 (FIG. 20) is started and rotates the pusher wheel 848 clockwise (FIG. 18). The pusher assembly 748 leaves the confines of the set of four guide grooves 824 of the pusher mounting structure 746 and enters the confines of the pair of channels 626 in both the basket top 110 and the basket bottom 108 as in FIG. 11 with the guide rails 862 above and below ribs 8621 and 8622 in the basket top 110 and the basket bottom 108, respectively. The set of four pusher bars 860 contact the side of the stack of cartons 16 and moves it laterally to the left into the cassette receiver 18 (FIG. 1). Referring to FIG. 18, a switch trip 868 that is fixedly mounted to the output end of the wheel shaft 832, rotates around until its long end comes in contact with a switch arm and roller 870 of a limit switch LS-2, which makes the circuit that turns off the motor 834, thereby halting the pusher assembly 748 when the pusher assembly 748 is fully extended. As the pusher wheel 848 turns and extends the pusher assembly 748, a bar trip 872 mounted on spokes of the wheel 848 comes in contact with a switch arm and roller 874 of a limit switch LS-12. The limit switch LS-12 is then actuated indicating that the pusher assembly 748 is in interference with the cassette receiver 18. When the pusher assembly 748 has been fully extended, as indicated by the limit switch LS-2, the motor 834 is started in the reverse direction, retracting the pusher assembly 748 and also rotating the bar trip 872 out of contact with the limit switch LS-12. As the pusher assembly retracts, the bottom bar of the set of four pusher bars 860 contacts and depresses a switch arm and roller 876 of a limit switch LS-18 to indicate that the pusher assembly 748 is fully retracted. A safety stop 877 fixedly mounted to the pusher wheel plate 826 prevents the pusher wheel 848 from rotating past a wheel stop 878 in case of circuit failure. The limit switch LS-18 also makes the circuit that commands the basket assembly to turn to its infeed position. The tip cylinder rod 734 (FIG. 17) is then extended bringing the basket assembly 102 into its no turn infeed position. A switch arm and roller 882 (FIG. 11) of a limit switch LS-9 is thereby depressed which will command the basket assembly 102 to turn if the machine is in the turn mode. For this example, the turn cylinder 536 retracts the rod 538, rotating the basket assembly counterclockwise as seen from above until the switch trip 592 (FIG. 17) contacts the limit switch assembly LS-26-30 making the circuit that stops the basket assembly in the turned position. The limit switch assembly LS-26-30 also makes the circuit that calls for the vertical stack pusher assembly 100 to advance with another stack of cartons 16.

OPERATION

The operation of the machine will now be described in greater detail with reference to FIGS. 21–23 which show electrical connections of the machine, FIG. 24 which shows hydraulic connections of the machine, and FIG. 25 which shows pneumatic connections.

Figure 21:
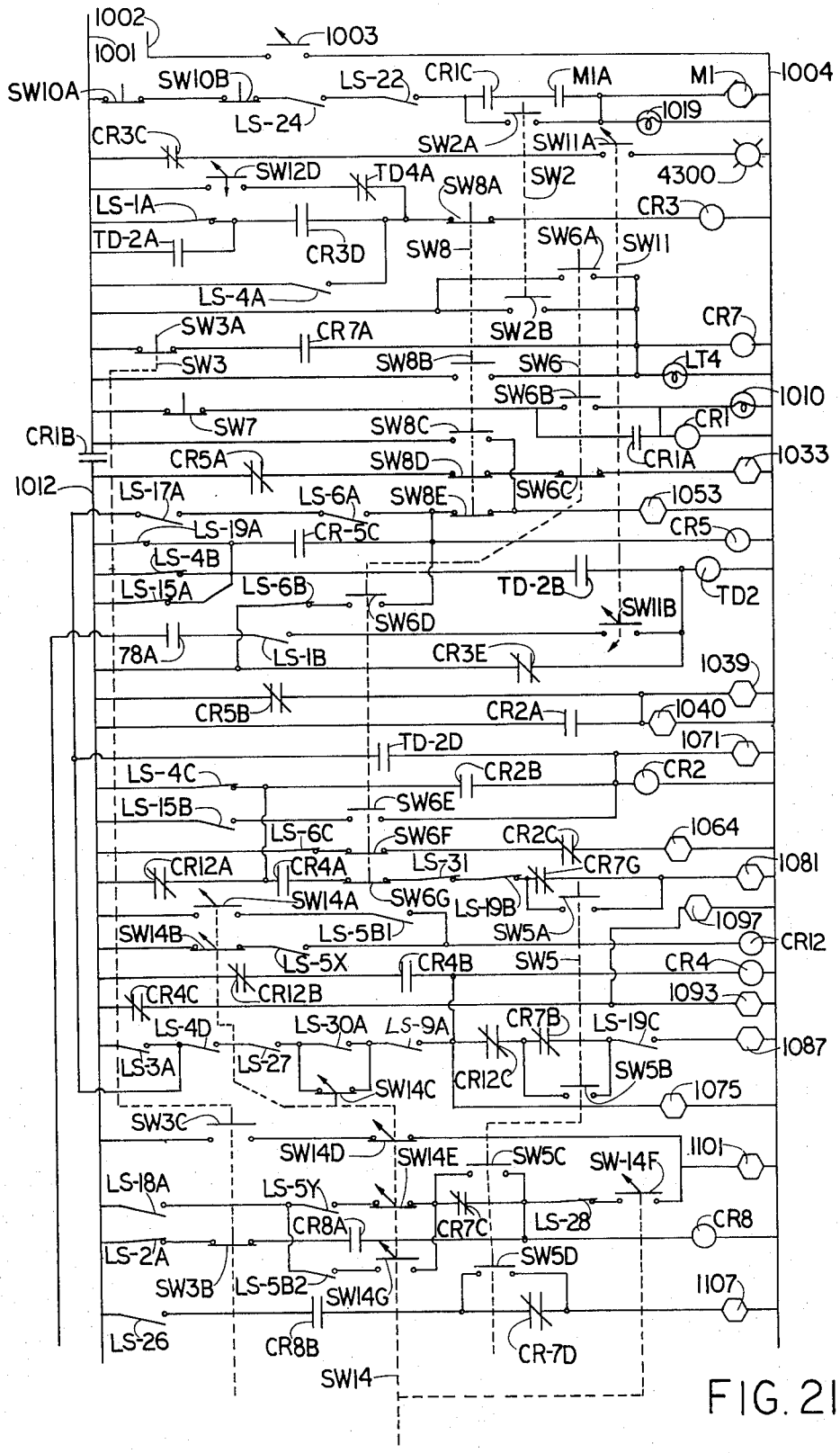
FIG. 21 is a schematic view showing electrical connections of the machine.

Alternating current electric power is supplied by power main leads 1001 and 1002 (FIG. 21). A main on-off switch 1003 can be closed to connect the power main lead 1002 to a power lead 1004 (FIGS. 21 and 23). A rectifier network 1006 (FIG. 23) is connected across the main power lead 1001 and the power lead 1004 and supplies direct current across direct current power leads 1007 and 1008.

Safety limit switches LS-24 and LS-22 (FIG. 21) can be provided which are closed when access doors or the like (not shown in detail) are closed. A rotation selector switch SW14 is provided having contacts SW14A, SW14B, SW14C, SW14D, SW14E, SW14F, SW14G, SW14H and SW14J. When the switch contacts of SW14 are in the position shown, the machine operates in a no turn mode, i.e., the basket assembly 102 is not turned to the FIG. 13 position during a cycle. When the contacts of the rotation selector switch SW14 are in their position, the basket assembly 102 is turned to the FIG. 13 position before a stack is received thereby. The operation will initially be described in the turn mode at which the switch SW14 is in its other position.

Figure 22:
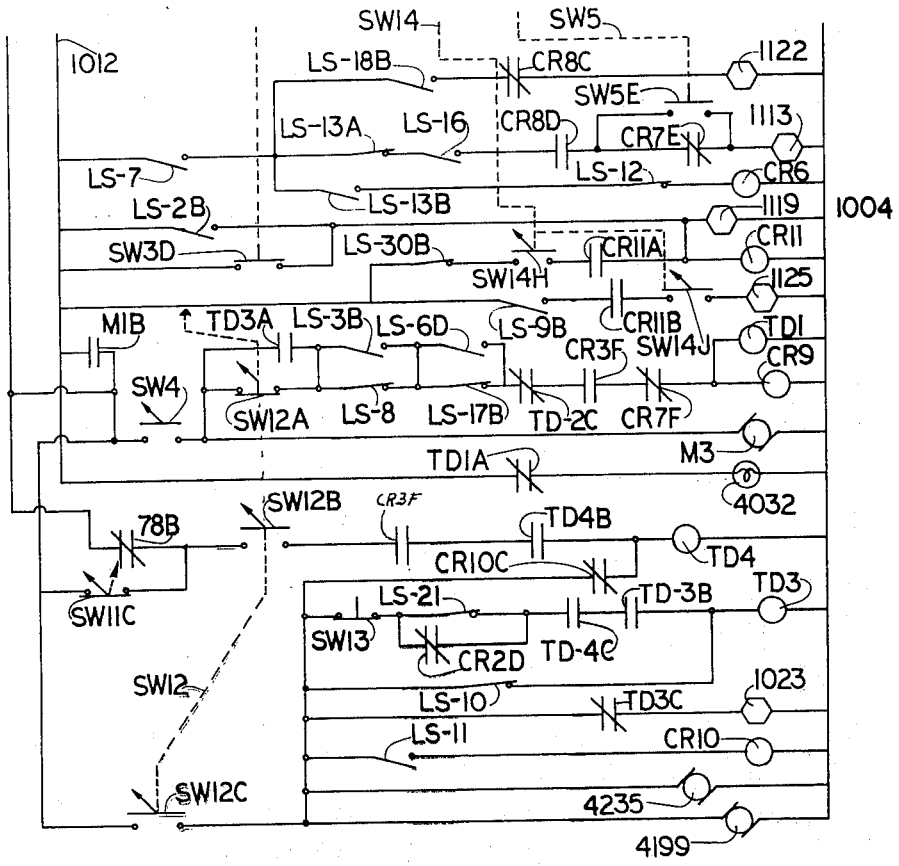
FIG. 22 is a schematic view showing further electrical connections of the machine.
Figure 23:
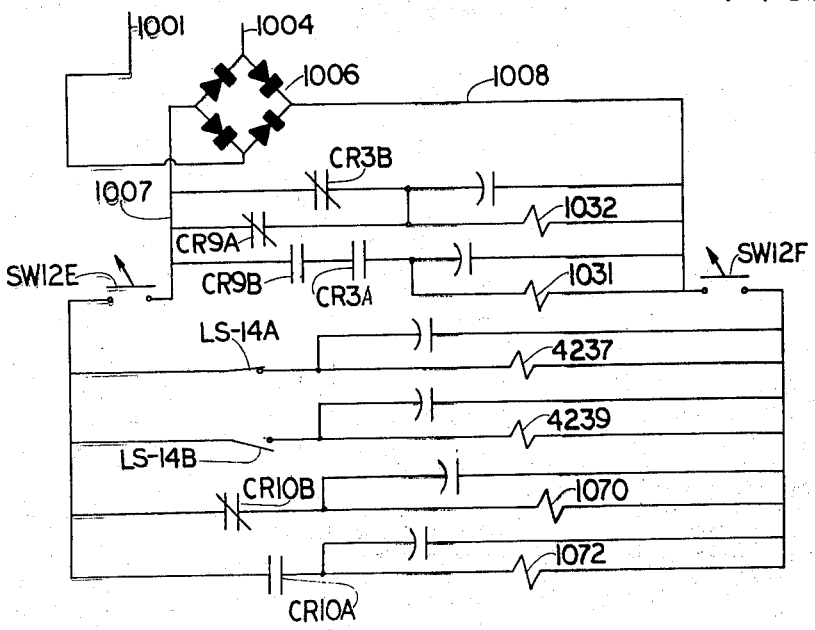
FIG. 23 is a schematic view showing direct current electrical connections of the machine.

A pack selector switch SW11 is provided which includes contacts SW11A (FIG. 21), SW11B and SW11C (FIG. 22). When the pack selector switch SW11 is in the position shown, the machine processes a stack of a selected height determined by the height of the main elevator assembly 94 when the limit switch LS-1 (FIG. 3) is actuated. When the pack selector switch SW11 is in its other position, the size of the stack is determined by counter switch 78 (FIG. 1) having contacts 78A (FIG. 21) and 78B (FIG. 22). The contacts 78A close and the contacts 78B open when a stack has been formed with a predetermined number of cartons therein. The machine will be initially described with the pack selector switch SW11 in its other position for a stack packed on count.

When the machine is to be operated, a carton conveyor switch SW4 (FIG. 22) is advanced to its other position permitting energizing of a carton conveyor motor M3.

Figure 26:
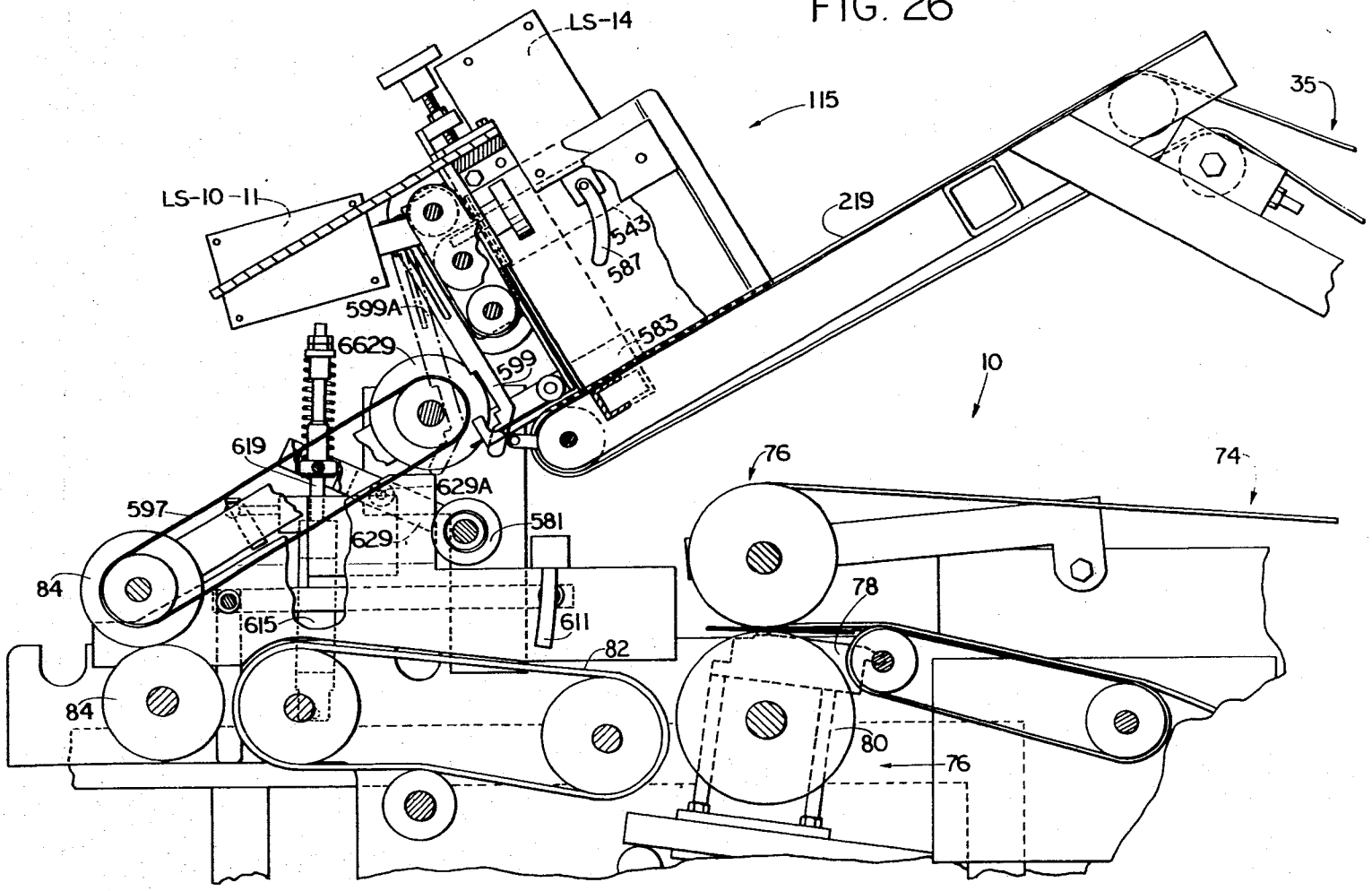
FIG. 26 is a view partly in side elevation and partly in upright section of a pad delivery assembly and a carton delivery assembly of the machine.

The machine can be constructed to place pads at upper and lower ends of a stack in the manner described in the aforementioned co-pending application Ser. No. 318,189. A pad selector switch SW12 (FIG. 22) is provided having contacts SW12A, SW12B, SW12C, SW12D (FIG. 21), SW12E (FIG. 23), and SW12F. When the pad selector switch SW12 is in the posiition shown, the machine forms a stack without pads. When the pad selector switch SW12 is in its other position, pads are positioned at the top and bottom of each stack. The machine will initially be described with the pad selector switch SW12 in position for delivery of a pad at the top and a pad at the bottom of each stack, i.e., in its other position. Closing of the contacts SW12C energizes the pad nip conveyor motor 4235 and the pad hopper conveyor motor 41999. When the limit switch LS-14 indicates pads are needed in the pad hopper 115 (FIG. 26), contacts LS-14A (FIG. 23) thereof close to energize a clutch solenoid 4237 which connects the pad hopper conveyor motor 4199 to drive the belt 229 (FIG. 2) to advance pads to the pad hopper 115. When the pad hopper 115 is sufficiently full that the limit switch LS-14 (FIG. 26) is actuated, contacts LS-14B (FIG. 23) of the limit switch LS-14 close to actuate a brake solenoid 4239 which stops advance of the belt 229 (FIG. 26).

When the machine is to be set in operation, a push button switch SW6 (FIG. 21) is advanced to its other position. The switch SW6 includes contacts SW6A, SW6B, SW6C, SW6D, SW6E, SW6F and SW6G. Closing of the contacts SW6B energizes a control relay CR1 to close contacts CR1A, CR1B and CR1C thereof. A lamp 1010 is lighted when the control relay CR1 is energized. Closing of the contacts CR1B connects the main power lead 1001 to a power lead 1012. A hydraulic start push button switch SW2 is advanced to its other position to close contacts SW2A and SW2B thereof. Closing of the contacts SW2A energizes a hydraulic drive motor M1 which drives a hydraulic pump 1013 (FIG. 24). The pump 1013 draws hydraulic fluid from a sump 1014 to supply hydrualic fluid under pressure to a pressure line 1016. The fluid returns to the sump through a return line 1017. A lamp 1019 (FIG. 21) is mounted in parallel with the motor M1 and is illuminated to show that the motor M1 is energized. Motor relay contacts M1A and M1B (FIG. 220 are closed when the motor M1 is energized. The motor M1 can be de-energized by opening of either of two emergency stop switches SW10A (FIG. 21) and SW10B. Closing of the contacts SW6A energizes a manual discharge relay CR7 which closes contacts CR7A and opens contacts CR7B, CR7C, CR7D, CR7E (FIG. 22), CR7F and CR7G (FIG. 21) thereof actuating machine clearing circuits to be described in geater detail hereinafter. A lamp LT4 is lighted when the control relay CR7 is energized. When the machine has been cleared, a cycle reset push button switch SW3 is advanced to its other position to open contacts SW3A and SW3B and to close contacts SW3C and SW3D (FIG. 22) thereof.

A manual call for pad switch SW13 is opened to deenergize a time delay relay TD3 permitting closing of delay action contacts TD3A, opening of instantaneous contacts TD3B and closing of instantaneous contacts TD3F thereof. Closing of the contacts TD3C energizes a solenoid 1023 to advance a valve 1024 (FIG. 24) to its other position to direct pressure fluid from the pressure line 1016 along a line 1026 to the right hand end of the cylinder 615 to cause retraction of the piston rod 619. Retraction of the piston rod 619 (FIG. 26) causes the yoke arm 629 to swing counterclockwise to bring the roll 581 upwardly to engage the end of a pad against the roll 6629 to cause delivery of a first pad to the rolls 84 which direct the first pad onto the flaps 91 of the auxiliary elevator assembly 90 (FIG. 4). After a predetermined delay, the time delay contacts TD3A (FIG. 22) close too energize a relay CR9 and a time delay relay TD1 to open contacts CR9A (FIG. 23) off the relay CR9 and to close contacts CR9B thereof. At this point a control relay CR3 (FIG. 21) is energized to close contacts CR3A (FIG. 23) and open contacts CR3B thereof. The circuit which energizes the control relay CR9 includes contacts of the limit switch LS-8 (FIG. 22) which prevents energizing of the control relay CR9 if the limit switch contacts LS-3B of the limit switch LS-3 (FIG. 2) are open indicating the stack pusher assembly is not retracted when the auxiliary elevator assembly 90 (FIG. 4) is sufficiently low to activate the limit switch LS-8. Closing the contacts CR9B energizes a conveyor clutch solenoid 1031 (FIG. 23) of a clutch (not shown in detail) which connects the motor M3 (FIG. 22) to drive the conveyor 70 (FIG. 2) causing delivery of cartons to the auxiliary elevator 90. Opening of the contacts CR9A (FIG. 23) de-energizes a conveyor brake solenoid 1032 to release a conveyor brake (not shown in detail) permitting operation of the conveyor 70 (FIG. 2). Energizing of the control relay CR3 (FIG. 21) also opens contacts CR3C, closes contacts CR3D, opens contacts CR3E, and closes contacts CR3F (FIG. 22). Opening of the contacts CR3C de-energizes an alarm 4300 (FIG. 21). Energizing of the time delay relay TD1 (FIG. 22) causes opening of contacts TD1A to de-energize a warning lamp 4032. The contacts TD-1A are set to reclose to activate the warning lamp 4032 if there is an undue delay in the progress of the cycle.

At this time a relay CR5 (FIG. 21) is de-energized to permit contacts CR5A and CR5B thereof to close and to permit contacts CR5C thereof to open. Closing of the contacts CR5A energizes a solenoid 1033 (FIG. 25) which advances an air valve 1034 to its other position. Air under pressure is supplied by an appropriate source 1036 of air under pressure to an air pressure line 1037, the air valve 1034, and a line 1038 to the left hand ends of the cylinders 250 to cause advance of the cylinder rods 252 as shown in FIG. 6 to advance the flaps 91 into stack supporting position. Closing of the contacts CR5B (FIG. 21) energizes solenoids 1039 and 1040. The solenoid 1039 advances a valve 1041 (FIG. 24) to its other position. The solenoid 1040 advances a valve 1042 to its other position.

Figure 24:
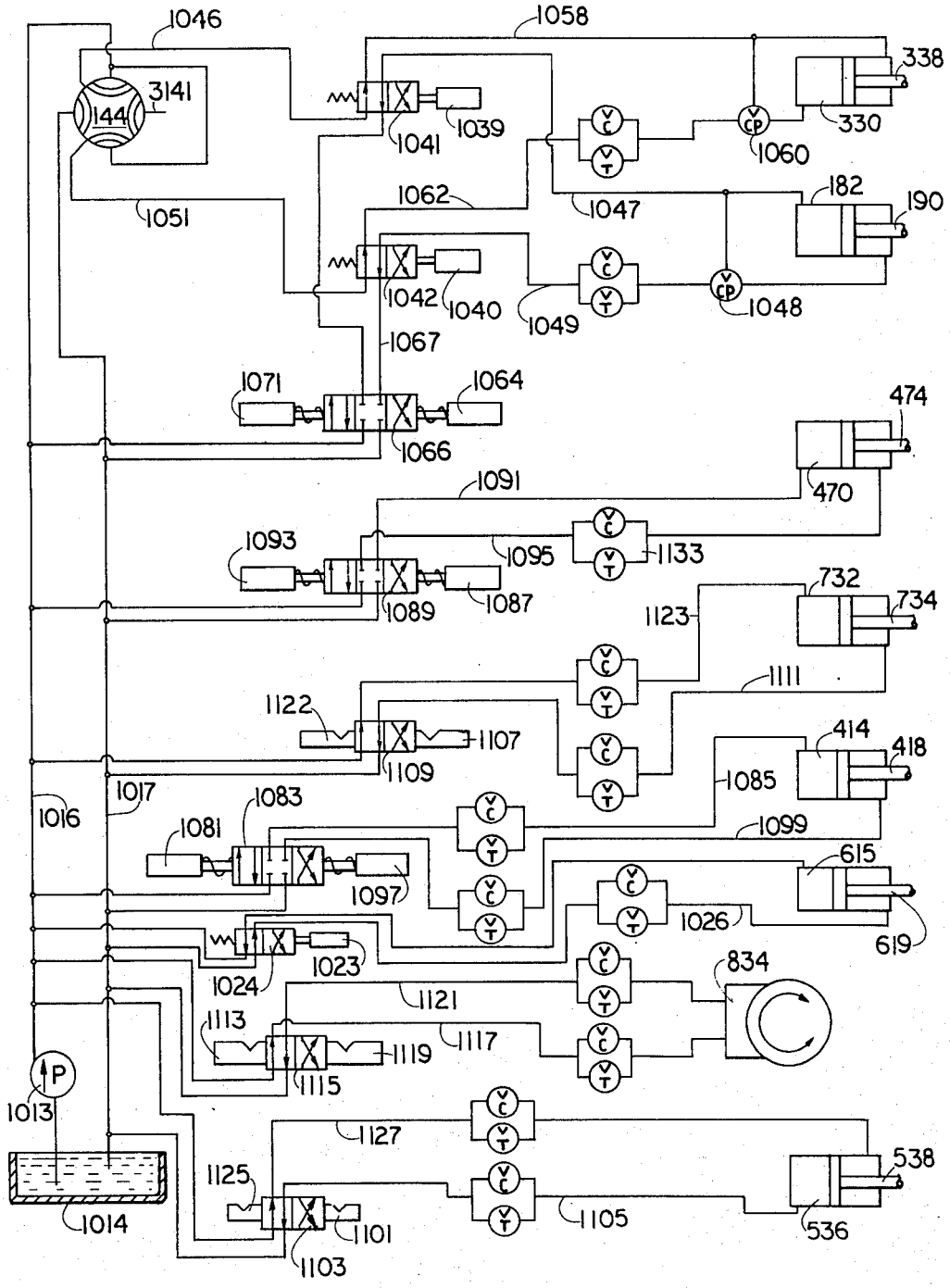
FIG. 24 is a schematic view showing hydraulic connections of the machine.
Figure 25:
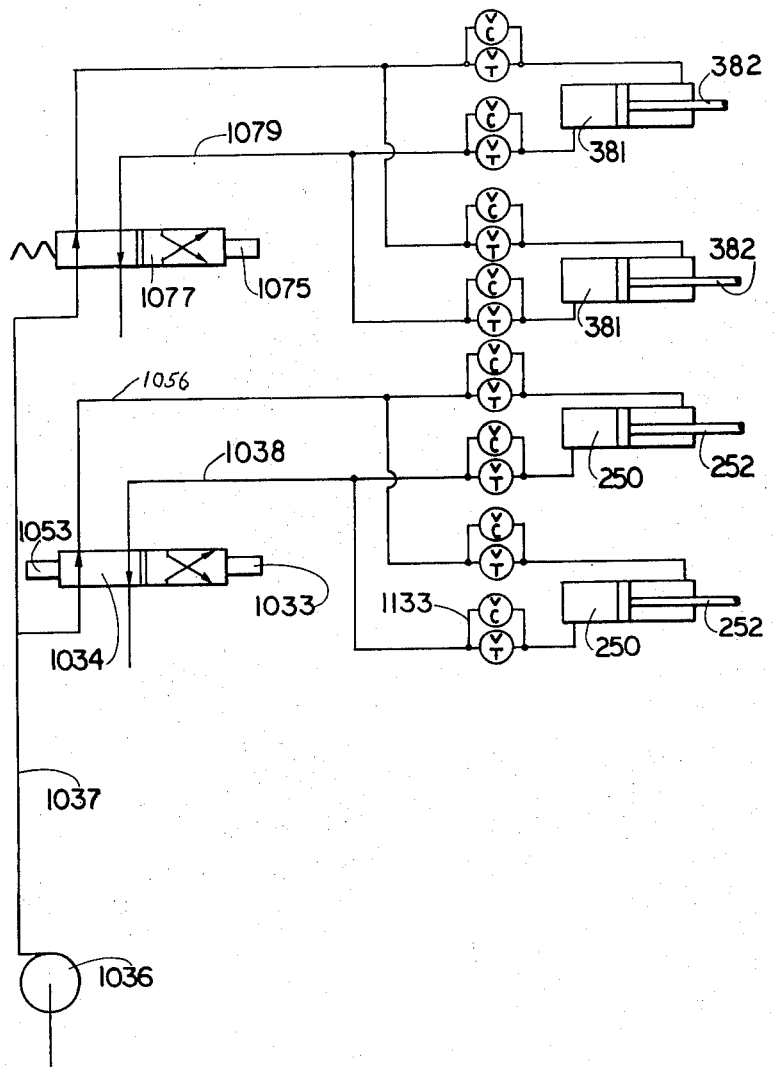
FIG. 25 is a schematic view showing pneumatic connections of the machine.

As cartons are delivered onto the flaps 91 (FIG. 6) of the auxiliary elevator assembly 90, the cartons build up under the control arm 86 (FIG. 4) swinging the control arm 86 clockwise as shown in FIG. 3A to draw the link 137 to the right as shown in FIG. 3 and swing the crank 3141 counterclockwise as shown in FIGS. 3 and 24 to actuate the microtorque valve 144. As the microtorque valve 144 swings counterclockwise as shown in FIG. 24, fluid under pressure from the line 1016 is directed along a line 1046 and through the valve 1041 and a line 1047 to the auxiliary elevator cylinder 182 to advance the auxiliary elevator cylinder rod 190 to cause lowering of the auxiliary elevator assembly 90 (FIG. 4). The fluid returns from the cylinder 182 through a pressure controlled check valve 1048 (FIG. 24), a line 1049, the valve 1042, a line 1051, and the microtorque valve 144 to the return line 1017. The pressure controlled check valve 1042 allows fluid to pass through the line 1049 only when there is a positive pressure in the line 1047.

As the stack 16A (FIG. 4) accumulates on the flaps 91 and 91A, the auxiliary elevator assembly 90 moves downwardly until the limit switch trip 284 engages the switch arm and roller 310 of the limit switch LS-17 to actuate the limit switch LS-17 and close contacts LS-17A (FIG. 21) and open contacts LS-17B (FIG. 22). AT this point, the main elevator assembly 94 (FIG. 3) is in raised posiion and the limit switch arm and roller 348 is engaged by the limit switch trip 342 to actuate the limit switch LS-6 and close contacts LS-6A (FIG. 21), open contacts LS-6B and LS-6C and close contacts LS-6D (FIG. 22) thereof. Thus, when the contacts LS-17A (FIG. 21) close, a solenoid 1053 and a control relay CR5 are energized. Energizing of the solenoid 1053 (FIG. 25) moves the air valve 1034 to the position shown to direct air through a line 1056 to the air cylinders 250 to cause retraction of the piston rods 252 to cause withdrawal of the flaps 91 and 91A to the full line position of FIG. 4 and FIG. 6 to release the partial stack 16A (FIG. 4) onto the main elevator arms 326. Energizing of the control relay CR5 (FIG. 21) opens the contacts CR5B to deenergize the solenoids 1039 and 1040 to permit the valves 1041 and 1042 (FIG. 24) to return to the positions shown and, as the stack continues to build up and the microtorque valve 144 swings counterclockwise, pressure in the line 1046 is directed through the valve 1041 and a line 1058 to the main elevator cylinder 330 to cause retraction of the main elevator cylinder rod 338 causing controlled lowering of the main elevator arms 326 (FIG. 3). Fluid returns from the cylinder 330 (FIG. 240 through a pressure controlled check valve 1060, a line 1062, the valve 1042, the line 1051, and the microtorque valve 144 to the return line 1017. The pressure controlled check valve 1060 permits retraction of the cylinder rod 338 only when there is a positive pressure in the line 1038.

As the main elevator assembly 94 (FIG. 3) starts downwardly, the limit switch contacts LS-6C (FIG. 21) close to energize a solenoid 1064 to advance a valve 1066 (FIG. 24) to the left to deliver fluid from the pressure line 1016 through a line 1067, the valve 1042, and the line 1049 to the cylinder 182 to cause retraction of the cylinder rod 190 raising the auxiliary elevator assembly 90 (FIG. 4). When the auxiliary elevator assembly reaches its fully raised position, the trip 312 (FIG. 30 acutates the limit switch LS-14 to open contacts LS-15A (FIG. 21) and close contacts LS-15B.

When the stack approaches the proper height, the limit switch LS-1 (FIG. 3) is actuated to close contacts LS-1B (FIG. 21). Then, the proper number of cartons has accumulated on the stack, the counter switch contacts 78A close and the counter switch contacts 78B (FIG. 22) open. When the counter switch contacts 78A close, a time delay relay TD2 (FIG. 21) is energized to close instantaneous contacts TD2A, TD2B, to open instantaneous contacts TD2C (FIG. 22) and to close time delay contacts TD2D (FIG. 21). In normal operation contacts LS-1A of the limit switch LS-1 open a sufficient time after the closing of the contacts LS-1B to permit closing of the instantaneous contacts TD2A before the contacts LS-1A open, and, in normal operation of the machine in packing on a count, the contacts LS-1A do not affect the operation of the machine. Opening of the instantaneous contacts TD2C (FIG. 22) de-energizes the relays CR9 and TD1. When the relay CR9 is de-energized, the contacts CR9A (FIG. 23) close to energize the conveyor brake solenoid 1032 and the contacts CR9B open to de-energize the conveyor clutch solenoid 1031 so that the conveyor 70 (FIG. 2) is stopped to arrest delivery of cartons. When there has been a sufficient time delay to permit delivery to the stack of all cartons which have been counted, the time delay contacts TD2D (FIG. 21) close to energize a control relay CR2 and a solenoid 1071. Energizing of the control realy CR2 closes contacts CR2A and CR2B and opens contacts CR2C and CR2D (FIG. 22) thereof.

Opening of the contacts 78B (FIG. 22) de-energizes a time delay relay TD4. When the time delay relay TD-4 is de-energized, time delay contacts TD4A (FIG. 21) close and time delay contacts TD4C (FIG. 22) open after a delay sufficient to permit the last counted carton to reach the stack before a pad is delivered. Instantaneous contacts TD4B also open when the time delay relay TD4 is de-energized. Opening of the contacts TD4C de-energizes the time delay realy TD3 to open the time delay contacts TD3A, to open the instantaneous contacts TD3B and to close the instantaneous contacts TD3C. Closing of the contacts TD3C energizes the solenoid 1023 which causes delivery of a pad as already explained. When the pad has been delivered, the switch actuator 599 (FIG. 26) of the limit switch assembly LS-10-11 is released and contacts of a limit switch LS-11 (FIG. 22) of the limit switch assembly LS-10-11 open to de-energize a control relay CR10 and contacts of a limit switch LS-10 of the assembly LS-10-11 close. Closing of the limit switch contacts LS-10 energizes the time delay relay TD3. Opening of the limit switch contacts LS-11 de-energizes the control relay CR10 to open contacts CR10A (FIG. 23) to close controls CR10B, and to close contacts CR10C (FIG. 22). Closing of the contacts CR10C re-energizes the time delay relay TD4. Closing of the contacts CR10B (FIG. 23) energizes a clutch solenoid 1070 which connects a pad conveyor (not shown in detail) to the pad conveyor motor 4199 (FIG. 22) to advance a new pad to a position where the new pad actuates the limit switch assembly LS-10-11. Opening of the contacts CR10A de-energizes a brake solenoid 1072 of the pad conveyor to release the pad conveyor to advance pads into position.

Opening of the contacts CR2C de-energizes the solenoid 1064 so that the solenoid 1071 can advance the valve 1066 (FIG. 24) to the right. Closing of the contacts CR2A (FIG. 21) energizes the solenoids 1037 and 1040 so that the valves 1041 and 1042 (FIG. 24) are advanced to thier other positions and pressure fluid from the line 1016 is directed through the valve 1066, a line 1073, the valve 1041, and the line 1058 to the upper end of the main elevator cylinder 330 to lower the main elevator assembly 94 (FIG. 2) rapidly to lower the completed stack.

When the main elevator assembly 94 reaches its lowermost position, the limit switch LS-4 (FIG. 3) is actuated to close contacts LS-4A (FIG. 21), open contacts LS-4B and LS-4C and close contacts LS-4D. Opening of the contacts LS-4C de-energizes the control relay CR2. Closing of the contacts LS-4D energizes a control relay CR4 and a solenoid 1075. Energizing of the solenoid 1075 advances an air valve 1077 (FIG. 25) to its other position so that air under pressure from the line 1037 is directed through a line 1079 to the cylinders 381 to cause extension of the cylinder push rods 382 and to advance the compressor flaps 96 (FIG. 8) into position above the stack. When the flaps 96 are in this position, the limit swich LS-31 (FIGS. 3, 4 and 21) is released to close the contacts (FIG. 21) thereof. Energizing of the control relay CR4 (FIG. 21) causes closing of contacts CR4A and CR4B and opening of contacts CR4C thereof. Closing of the contacts CR4A energizes a solenoid 1081 to advance a valve 1083 (FIG. 24) to the right to direct pressure fluid from the pressure line 1016 through the valve 1083 and a line 1085 to the compressor cylinder 414 to cause extension of the compressor cylinder rod 418 and lowering of the compressor flaps 96 (FIG. 4) to compress the stack on the main elevator arms 326 (FIG. 4). The compressor assembly 98 (FIG. 2) squeezes the stack so that the stack can be received between the basket bottom 108 and the basket top 110 in the manner the stack 16B is shown in FIG. 11.

As the compressor assembly 98 (FIG. 2) approaches fully lowered position, the plunger 450 (FIG. 4) is depressed to actuate the limit switch LS-21 to open the contacts (FIG. 22) thereof. The limit switch LS-21 is a pulse switch, and the contacts open and close again immediately. Opening of the contacts of the limit switch LS-21 de-energizes the time delay relay TD3 to permit delivery of a pad to start the next stack. Then, when the compressor assembly 98 (FIG. 2) reaches fully down position, the limit switch LS-19 (FIG. 4) is actuated to open contacts LS-19A (FIG. 21) and LS-19B and to close contacts LS-19C thereof. Opening of the contacts LS-19A de-energizes the control relay CR5 closing contacts CR5A thereof to permit closing of he auxiliary elevator flaps 91 and 91A (FIG. 4). Opening of the contacts LS-19B de-energizes the solenoid 1081. Closing of the contacts LS-19C energizes a solenoid 1087 to move a valve 1089 (FIG. 24) to the left so that pressure flud from the pressure line 1016 is directed through the valve 1089, and a line 1091 to the pusher cylinder 470 to advance the cylinder rod 474 and cause the lower pusher arms 476 and the upper pusher arms 484 of the vertical stack pusher 100 to advance to the left as shown in FIG. 2 to discharge the stack from the main elevator assembly 94 into the basket assembly 102.

When the machine is operating in a turn mode, the basket assembly 102 is in the FIG. 13 position as the stack is advanced into the basket assembly 102. When the stack has been advanced into the basket assembly 102, the limit switch LS-5B (FIG. 2) is actuated to close contacts LS-5B1 (FIG. 21) and LS-5B2 thereof. Closing of the contacts LS-5B2 energizes a control relay CR8 to close contacts CR8A and CR8B, to open contacts CR8C (FIG. 22) and to close contacts CR8D. Closing of the contacts LS-5B1 energizes a control relay CR12. Energizing of the control relay CR12 opens contacts CR12A, CR12B and CR12C. Opening of the contacts CR12C de-energizes the solenoid 1087. De-energizing of the contacts CR12B de-energizes the control relay CR4 to permit the contacts CR4C to close to energize a solenoid 1093 which advances the valve 1089 (FIG. 24) to the right to direct pressure fluid from the pressure line 1016 through a line 1095 to the cylinder 470 to cause retraction of the cylinder rod 474 and return of the vertical stack pusher 100 (FIG. 2). Closing of the contacts CR4C (FIG. 21) also energizes a solenoid 1097 which advances the valve 1083 (FIG. 24) to the left so that the pressure fluid is directed along a line 1099 to the compressor cylinder 414 to cause retraction of the compressor rod 418 and raising of the compressor assembly 98 (FIG. 2).

When the machine is operated in a no turn mode, the basket assembly is in the FIG. 12 position as the stack is advanced into the basket assembly and the limit switch LS-5 is actuated to close contacts LS-5X (FIG. 21) and LS-5Y, the control relay CR12 being energized by closing of the contacts LS-5X.

When the vertical stack pusher 100 has been retracted sufficiently to be free of the basket assembly 102, the limit switch LS-28 is released to allow the contacts (FIG. 21) thereof to close to energize a solenoid 1101 and advance a valve 1103 (FIG. 24) to the left to direct pressure fluid from the pressure line 1016 along a line 1105 to the turn cylinder 536 to cause extension of the turn cylinder rod 538 to cause swinging of the basket assembly 102 from the FIG. 13 position to the FIG. 12 position.

When the vertical stack pusher 100 has been fully retracted, the limit switch LS-3 is actuated to close contacts LS-3A (FIG. 21) and LS-3B (FIG. 22) thereof.

When the basket assembly 102 reaches the FIG. 12 position, the limit switch LS-26 of the limit switch assembly LS-26-30 (FIG. 17) is actuated to close the contacts (FIG. 21) thereof to energize a solenoid 1107. Energizing of the solenoid 1107 advances a valve 1109 (FIG. 24) to the left to direct pressure fluid along a line 1111 to the tip cylinder 732 to cause retraction of the tip cylinder rod 734 and to cause counterclockwise swinging of the basket assembly 102 about the axis of the tip shaft 658 as shown in FIGS. 2 and 17 to bring the basket asembly to the lowered position shown in FIG. 11 at 102A in dot-dash lines. When the basket assembly reches the position 102A, the limit swich LS-7 (FIG. 18) is actuated to close the contacts (FIG. 22) thereof. Closing of the contacts LS-7 energizes a solenoid 1113 which advances a valve 1115 (FIG. 24) to the position shown to direct fluid along a line 1117 to the motor 834 to cause advance of the push-off assembly 106 (FIG. 18) to advance the stack from the basket assembly 102 into the cassette receiver 18 (FIG. 1) of the customer machine (not shown in detail). When the stack is received in the cassette receiver 18, a limit switch (not shown in detail) mounted on the customer machine is actuated to open contacts LS-13A (FIG. 22) and to close contacts LS-13B thereof. Closing of the contacts LS-13B actuates a control relay CR6 which starts operation of the customer machine. Opening of the contacts LS-13A de-energiizes the solenoid 1113.

When the pushoff assembly 106 is fully extended, the limit switch LS-2 (FIG. 18) is actuated to open contacts LS-2A (FIG. 21) and close contacts LS-2B (FIG. 22). Closing of the contacts LS-2B energizes a control relay CR11 and a solenoid 1119 which moves the valve 1115 (FIG. 24) to the left to direct pressure fluid along a line 1121 to the motor 834 to cause retraction of the pushoff assembly 106 (FIG. 18). Energizing of the control relay CR11 closes contacts CR11A and CR11B thereof.

When the pushoff assembly 106 is fully retracted, the limit switch LS-18 (FIG. 18) is actuated to close contacts LS-18A (FIG. 21) and LS-18B (FIG. 22) thereof. Closing of the contacts LS-18B energizes a solenoid 1122 to advance the valve 1109 (FIG. 24) to the position shown to direct fluid along a line 1123 to the tip cylinder 732 to cause return of the basket assembly 102 to the FIG. 11 full line position. When the basket assembly 102 reaches this position, the limit switch LS-9 (FIG. 11) is actuated to close contacts LS-9A (FIG. 21) and LS-9B (FIG. 22) thereof. Closing of the contacts LS-9B energizes a solenoid 1125 which advances the valve 1103 (FIG. 24) to the position shown to direct fluid along a line 1127 to the turn cylinder 536 to cause return of the basket assembly 102 to the FIG. 13 position. When the basket assembly 102 reaches the FIG. 13 position, the limit switch LS-36 of the limit switch assembly LS-26-30 (FIG. 17) is actuated to close contacts LS-30A (FIG. 21) and open contacts LS-30B (FIG. 22) thereof.

Check valve-throttle valve assemblies 1133 (FIGS. 24 and 25) are provided in various of the hydraulic and pneumatic lines to permit contnrol of the speed of advance of the various penumatically and hydraulically powered units.

When the machine packs on carton count, the control relay CR3 normally remains energized. However, if there is a machine failure and the machine fails to reach a count of cartons after closing of limit switch contacts LS-1B, and before opening of the contacts LS-1A, the control relay CR3 is de-energized to actuate the alarm 4300. When the switch SW11 is in the position shown so that the machine packs on stack height, contacts SW11A thereof are open so that the alarm 4300 is not activated on de-energizing of the control relay CR3 and the control relay CR3 is de-energized on opening of the contacts LS-1A to open the contacts CR3B (FIG. 23) to stop the conveyor 70 (FIG. 2) and institute the series of steps above described to discharge the stack of the height determined by the contacts LS-1A.

If there is a machine malfunction and it is necessary to discharge an improper or partially formed stack without rejection thereof, a push button switch SW5 (FIG. 21) can be actuated to advance the improper stack step by step. Actuation of the switch SW5 closes contacts SW5A, SW5B, SW5C, SW5D, and SW5E (FIG. 22) thereof. If it is desired to remove the improper stack without stopping at each step, a reject push button switch SW8 (FIG. 21) can be actuated to open contacts SW8A, to close contacts SW8B and SW8C and to open contacts SW8D and SW8E. The control relay CR1 can be de-energized by opening a push button switch SW7.

The bundling machine structure of this invention makes it possible to handle stacks of articles of varying dimensions. The stack is delivered to the basket assembly 102 (FIG. 2) by the pusher assembly 100 with the height of the basket bottom 108 and the basket top 110 being constant for various sizes of articles. However, the position of the basket tray 566 (FIG. 11) can be changed and adjusted to accommodate stacks of articles of various sizes, and the height of the basket tray 566 at the layover position can be regulated to be the same for various sizes of articles to permit proper discharge of the stack from the basket assembly 102 because of the angled adjustment of the position of hte shaft 658 (FIG. 2). The turn box assembly 112 makes it possible to accommodate articles having an article length which would interfere with the cassette 18 (FIG. 1) if it were not for the turn box features.

The bundling machine illustrated in the drawings and described above is subject to structural modification without departing from the spirit and scope of the appended claims.

Having described our invention, what we claim as new and desire to secure by letters patent is:

1. In a machine for bundling flat articles in a compressible stack, a stack compressing assembly which comprises a horizontal elevator platform, means for delivering the stack of articles onto the elevator platform, means for advancing the elevator platform to a stack delivery level, a stack compressor frame mounted for up and down movement adjacent the stack delivery level, an upright crank arm pivotally mounted at a lower end of the stack compressor frame, a stack engaging flap attached to an upper end of the crank arm, means for swinging the crank arm between a retracted position in which the flap is free of the stack and an advanced position in which the flap overlies the stack on the elevator platform at discharge level and the flap is substantially horizontal, means for lowering the stack compressor frame to cause the flap to engage and compress the stack, and means for discharging the stack from between the elevator platform and the flap in a horizontal direction while compressed.

2. A machine as in claim 1 wherein there is an upright guide plate mounted on the stack compressor frame and engageable with the stack on the elevator platform and, when the crank arm is in retracted position, the flap is free of a stack engaging face of the guide plate and, when the crank arm is in advanced position, the flap overlies said stack engaging face.

3. A machine as in claim 1 wherein the means for swinging the crank arm includes first link means pivotally connected to the stack compressor frame, a second link means pivotally connected to the crank arm, means for pivotally connecting the first and second link means, and means for advancing the pivotal connection between the first and second link means toward and away from alignment with the other pivotal connections of the link means.

4. In a machine for bundling flat articles in a compressible stack, a stack compressing assembly which comprises a horizontal platform, means for delivering the stack of articles onto the platform, a stack compressor frame mounted for up and down movement adjacent the platform, an upright crank arm pivotally mounted at a lower end of the stack compressor frame, a stack engaging flap attached to an upper end of the crank arm means for swinging the crank arm between a retracted position in which the flap is free of the stack and an advanced position in which th flap overlies the stack on the platform and the flap is substantially horizontal, means for lowering the stack compressor frame to cause the flap to engage and compress the stack, and means for discharging the stack from between the platform and the flap while compressed.

5. In a machine for bundling flat articles in a compressible stack a stack compressing asembly which comprises a horizontal elevator platform, means for delivering the stack of articles onto the elevator platform, means for advancing the elevator platform to a stack delivery level, a pair of stack compressor frames mounted for up and down movement on opposite sides of the stack adjacent the stack delivery level, a pair of upright crank arms, each crank arm being pivotally mounted at a lower end of an associated one of the stack compressor frames, a stack engaging flap attached to an upper end of each crank arm, means for swinging each crank arm between a retracted position in which the flapp associated therewith is free of the stack and an advanced position in which the flap overlies the stack on the elevator platform at discharge level and the flap is substantially horizontal, means for lowering the stack compressor frames to cause the flaps to engage and compress the stack, and means for discharging the stack from between the elevator platform and the flaps in a horizontal direction while compressed.

6. A machine as in claim 5 wherein there is an upright guide plate mounted on each of the stack compressor frames and engageable with the stack on the elevator platform and, when the crank arms are in retracted position, the flaps are free of stack engaging faces of the guide plates and, when the crank arms are in advanced position, the flaps overlie said stack engaging faces.

7. A machine as in claim 5 wherein the means for swinging each of the crank arms includes first link means pivotally connected to the associated stack compressor frame, a second link means pivotally connected to the crank arm, means for pivotally connecting the first and second link means, and means for advancing the pivotal connection between the first and second link means toward and away from aligment with the other pivotal connections of the link means.

* * * * *